US008526856B2

(12) United States Patent
Otani

(10) Patent No.: US 8,526,856 B2
(45) Date of Patent: Sep. 3, 2013

(54) IMAGE FORMING UNIT HAVING BIASING PART THAT BIASES DEVELOPING UNIT TOWARD DRUM UNIT AND IMAGE FORMING DEVICE INCLUDING SAME

(75) Inventor: Shinichi Otani, Tokyo (JP)

(73) Assignee: Oki Data Corporation, Tokyo (JP)

( * ) Notice: Subject to any disclaimer, the term of this patent is extended or adjusted under 35 U.S.C. 154(b) by 710 days.

(21) Appl. No.: 12/692,972

(22) Filed: Jan. 25, 2010

(65) Prior Publication Data

US 2010/0189466 A1 Jul. 29, 2010

(30) Foreign Application Priority Data

Jan. 26, 2009 (JP) ..... 2009-014129

(51) Int. Cl.
*G03G 15/00* (2006.01)

(52) U.S. Cl.
USPC ..... 399/167

(58) Field of Classification Search
USPC ..... 399/167
See application file for complete search history.

(56) References Cited

U.S. PATENT DOCUMENTS 6,424,811 B1 * 7/2002 Tsuda et al. ..... 399/167
2006/0056877 A1 * 3/2006 Okabe et al. ..... 399/119

FOREIGN PATENT DOCUMENTS

JP A-2006-048018 2/2006
JP A-2007-017472 1/2007
JP 2008-139818 A 6/2008

* cited by examiner

*Primary Examiner* — Walter L Lindsay, Jr.
*Assistant Examiner* — Ruth Labombard
(74) *Attorney, Agent, or Firm* — Posz Law Group, PLC

(57) ABSTRACT

An image forming unit includes a first rotating body having a first gear; a first unit that rotatably supports the first rotating body; a second rotating body having a second gear; a second unit that rotatably supports the second rotating body; and a biasing part that biases the second unit toward the first unit, wherein a drive force is generated by transmitting rotation from the first gear to the second gear in order to transmit the rotation from the first rotating body to the second rotating body, and the biasing part biases the second unit in a biasing direction substantially perpendicular to a driving direction of the drive force.

19 Claims, 18 Drawing Sheets

IMAGE FORMING UNIT HAVING BIASING PART THAT BIASES DEVELOPING UNIT TOWARD DRUM UNIT AND IMAGE FORMING DEVICE INCLUDING SAME

CROSS REFERENCE

The present application is related to, claims priority from and incorporates by reference Japanese patent application number 2009-014129, filed on Jan. 26, 2009.

TECHNICAL FIELD

The present invention relates to an image forming unit and an image forming device.

BACKGROUND

A conventional image forming device, for example, a printer, a photocopier, a facsimile machine, a multifunction machine, or the like, has an image forming unit. This image forming unit has a photoreceptor drum, a charge roller, a developing part, and so on. An LED head exposes the surface of the photoreceptor drum, which is uniformly charged by the charge roller, to form an electrostatic latent image. Then, the electrostatic latent image is developed by the developing part to form a toner image. The toner image is then transferred onto a sheet of paper by a transferring roller. The transferred toner image on the sheet of paper is fused by a fuser to form an image, and therefore, a printing operation is performed.

The developing part is located such that it contacts and pressed the photoreceptor drum. The developing part has a developing roller that operates to adhere toner onto the photoreceptor drum, a toner supplying roller that is located such that it contacts and presses the developing roller and supplies toner to the developing roller and so on.

When the photoreceptor drum is a first rotating body and the developing roller is a second rotating body, the first and second rotating bodies are required to uniformly contact and press each other in the shaft directions of the bodies during the course of assembling the printer. When the first and second rotating bodies are assembled in the printer, the position of the second rotating body is changed and adjusted while the pressing force is measured. Therefore, after the pressing force is adjusted, the first and second rotating bodies are assembled in the main body of the printer, i.e., the device main body. Japanese laid-open patent application publication number 2006-48018 provides an example of such a device.

Similarly, when the developing roller is a first rotating body and the toner supplying roller is a second rotating body, the first and second rotating bodies are required to uniformly contact and press each other in the shaft directions of the bodies. Side plates in which the size is controlled are provided on the both ends of the first and second rotating bodies, and then the first and second rotating bodies are assembled in the device main body. Japanese laid-open patent application publication number 2007-17472 provides an example of such a device.

However, in the conventional printer, it takes time for adjustment work when the first and second rotating bodies are uniformly contacted and pressed against each other in the shaft directions of the bodies. As a result, productivity (?) for assembling the printer was decreased.

Objects of the present invention are to provide an image forming unit and an image forming device in which first and second rotating bodies are easily and uniformly contacted and pressed against each other in the shaft directions of the bodies.

SUMMARY

For the purpose, an image forming unit of the present application includes a first rotating body having a first gear; a first unit that rotatably supports the first rotating body; a second rotating body having a second gear; a second unit that rotatably supports the second rotating body; and a biasing part that biases the second unit toward the first unit, wherein a drive force is generated by transmitting rotation from the first gear to the second gear in order to transmit the rotation from the first rotating body to the second rotating body, and the biasing part biases the second unit in a biasing direction substantially perpendicular to a driving direction of the drive force.

In this case, the biasing part biases the second unit in the approximately perpendicular direction to the direction of the drive force that is generated by transmitting rotation between the first and second gears through meshing the first and second gears.

Therefore, the first and second rotating bodies are easily and uniformly contacted and pressed in the shaft directions of the bodies. As a result, workability for assembling the printer is improved.

Also, the application discloses an image forming device including an image forming unit above.

DETAILED DESCRIPTION

Figure 10:
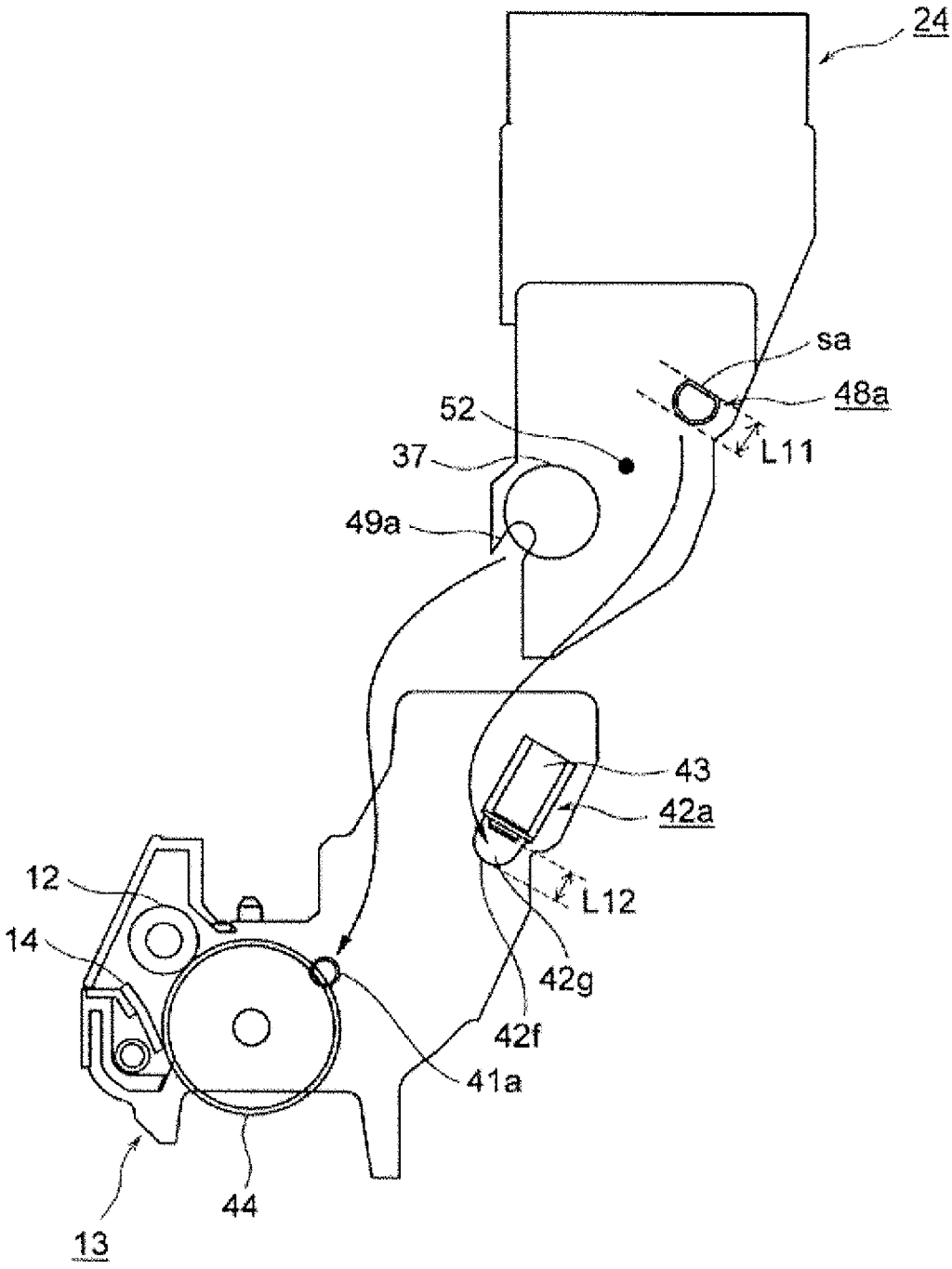
FIG. 10 is a first schematic view of movement when a developing unit is attached to a drum unit according to a first disclosed embodiment.

In the descriptions below, the designations a and b are used with some of the reference numerals. These refer to corresponding elements on opposite sides of different parts of the disclosed device. Although various drawings only show one of two matched elements depending upon which viewing direction the drawing represents (e.g., FIG. 10 shows element 48*a* but not 48*b*), the matching element that is not shown in the drawings operates in a manner comparable to the matching element that is shown in the drawings.

A first embodiment is explained in detail below with reference to drawings. In this embodiment, a printer that is an example of an image forming device is explained.

Figure 2:
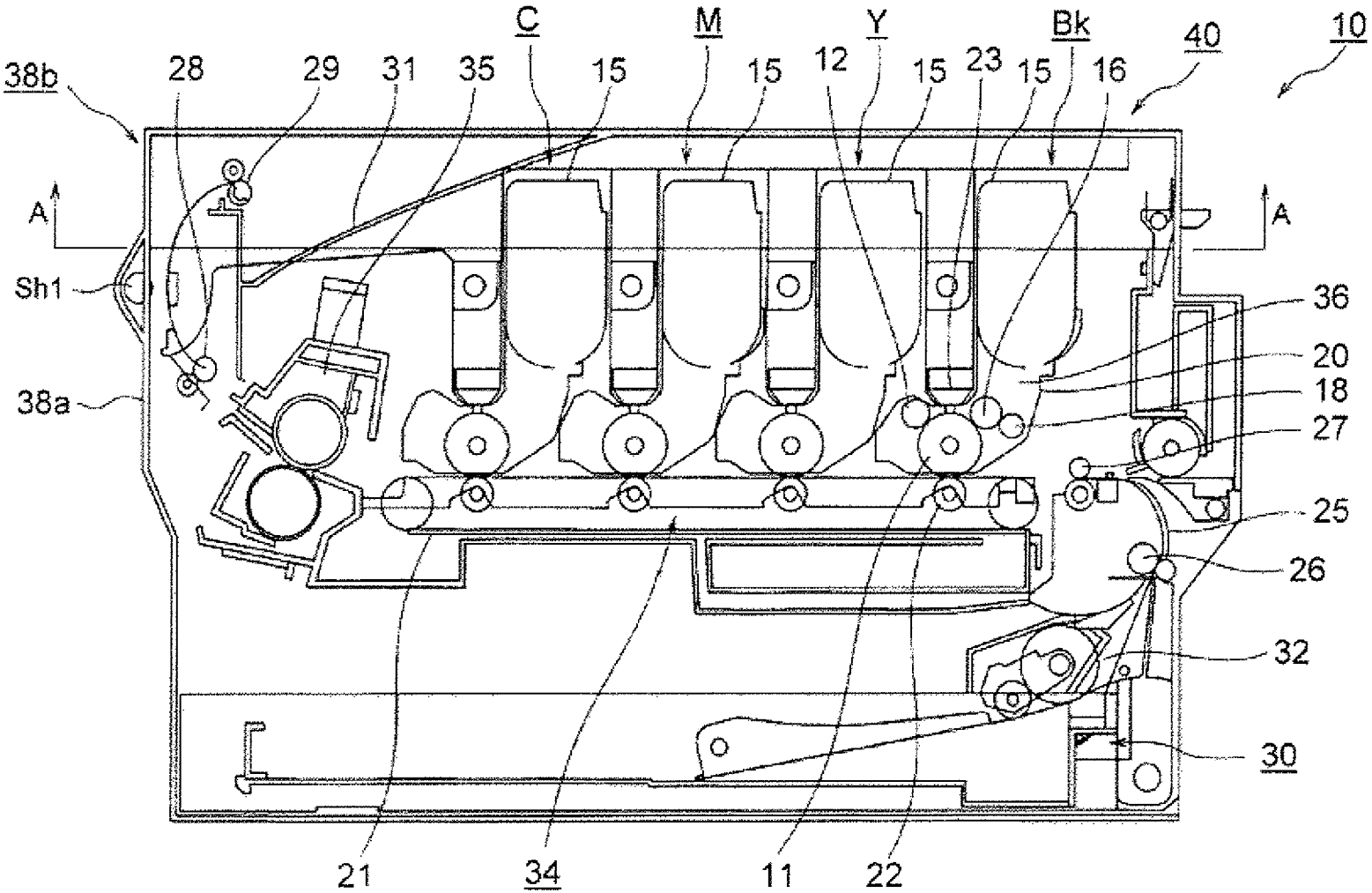
FIG. 2 is a schematic view of a printer according to a first disclosed embodiment.

FIG. 2 is a schematic view of the printer according to the first disclosed embodiment.

As shown in FIG. 2, a main body 10 of a printer 40, e.g., a device main body 10, includes a carrying path 25 for carrying a sheet (not shown) as a medium. Carrying rollers 26-29 are located in the carrying path 25. Image forming units (ID units), Bk, Y, M, and C, that are for forming a toner image as a developer image for black, yellow, magenta, and cyan, respectively, are provided along the carrying path 25. Each of the ID units, Bk, Y, M, and C, has a photoreceptor drum 11 as an image carrier.

LED heads 23, which are exposure devices and recording heads, are provided to face the photoreceptor drums 11 and are adjacent to each of the ID units, Bk, Y, M, and C. A transferring unit 34 is provided to carry a sheet and transfer each toner image onto the sheet. The transferring unit 34 is located below each of the ID units, Bk, Y, M, and C. A belt driving unit is configured with the transferring unit 34.

A fuser 35 is located at the downstream side of the ID units, Bk, Y, M, and C, in the carrying direction of the sheet and operates as a fusing device that fuses the toner image onto the sheet.

In each of the ID units, Bk, Y, M, and C, the photoreceptor drums 11 rotate at a certain rotation speed and are charged by the charge rollers 12 as a charging device, so that the photoreceptor drums 11 can store electric charge on the surface of the drums. When the electric charge on the surface of the drums is removed, an electrostatic latent image (not shown) is formed as a latent image on the surface of the photoreceptor drums 11. The charge rollers 12 contact and press the photoreceptor drums 11 with a certain amount of pressing force and rotate in the opposite direction compared with the rotation direction of the photoreceptor drums 11.

A developing part 36 develops the electrostatic latent image and forms the toner image. The developing part 36 is located adjacent to the photoreceptor drums 11. The developing part 36 has, for example, a developing roller 16 operating as a developer carrier that adheres toner as developer onto the photoreceptor drum 11, a developing blade (not shown) operating as a developer layer regulation part that regulates the toner thickness on the developing roller 16, and a toner supplying roller 18 operating as a developer supplying part that supplies toner to the developing roller 16. The developing roller 16 contacts and presses the photoreceptor drums 11 with a certain amount of pressing force and rotates in the opposite direction compared with the rotation direction of the photoreceptor drums 11. The toner supplying roller 18 contacts and presses the developing roller 16 with a certain amount of pressing force and rotates in the same direction compared with the rotation direction of the developing roller 16. The photoreceptor drums 11, the developing roller 16, the toner supplying roller 18 and so on configure an image forming component.

The photoreceptor drums 11, the charge roller 12, the developing part 36 and so on are contained in the main body of the ID units, Bk, Y, M, and C, i.e., an image forming unit (ID unit) main body 20. A toner cartridge 15, operating as a developer container that contains toner, is located above the ID unit main body 20 and is detachable from the ID unit main body 20.

The transferring unit 34 has a transferring belt 21 that flexibly rotates and transferring rollers 22, operating as transferring parts, that are located to face each of the photoreceptor drums 11. A certain voltage is applied to the transferring belt 21 and the transferring rollers 22 through a power source (not shown). Then toner images in each color on the photoreceptor drums 11 are sequentially transferred on the sheet to overlap each other.

The main body 10 has a lower cover 38 and an upper cover 39. The upper cover 39 is swingably provided with respect to the lower cover 38, with the spindle Sh1 serving as the center for the swing. The upper cover 39 opens and closes at the divided face A-A. A stacker 31, in which ejected sheets are loaded, is located at the upper cover 39. A sheet cassette 30, operating as a medium container that stores the sheets, is provided at the edge portion of the carrying path 25 under the transferring unit 34. A feeding part 34 that feeds the sheet is provided at the sheet cassette 30.

Next, operation of the printer 40 that has the structures mentioned above is explained.

An electrostatic latent image is formed in each of the ID units, Bk, Y, M, and C, when the surfaces of the photoreceptor drums 11 are uniformly charged by the charge rollers 12, and when the LED heads 23 expose the surfaces of the photoreceptor drums 11. Next, the developing part 36 develops the electrostatic latent image to form toner images in each color.

A sheet that is fed by the feeding part 32 is carried to the carrying rollers 26 and 27 and is adhered to the carrying belt 21 by electrostatic effect. The sheet is carried between each of the ID units, Bk, Y, M, and C, and the transferring unit 34 by the run of the transferring belt 21, so that a toner image in each color is transferred to overlap each other on the sheet. As a result, a color toner image is formed. The sheet is passed the fuser 35, which fuses the color toner image, forming a color image on the sheet. The sheet is further carried by the carrying rollers 28 and 29 and is ejected in the stacker 31.

The printer 40 also has an interface part (not shown) that receives print data by communicating with an external device (not shown) and a control part (not shown) that receives the print data from the interface part and controls the entire printer 40.

Next, each of the ID units, Bk, Y, M, and C, is explained. Because the structures of each of the ID units, Bk, Y, M, and C, are same, the ID unit Bk is explained below by way of example. The other ID units Y, M, and C operate in a similar manner.

Figure 3:
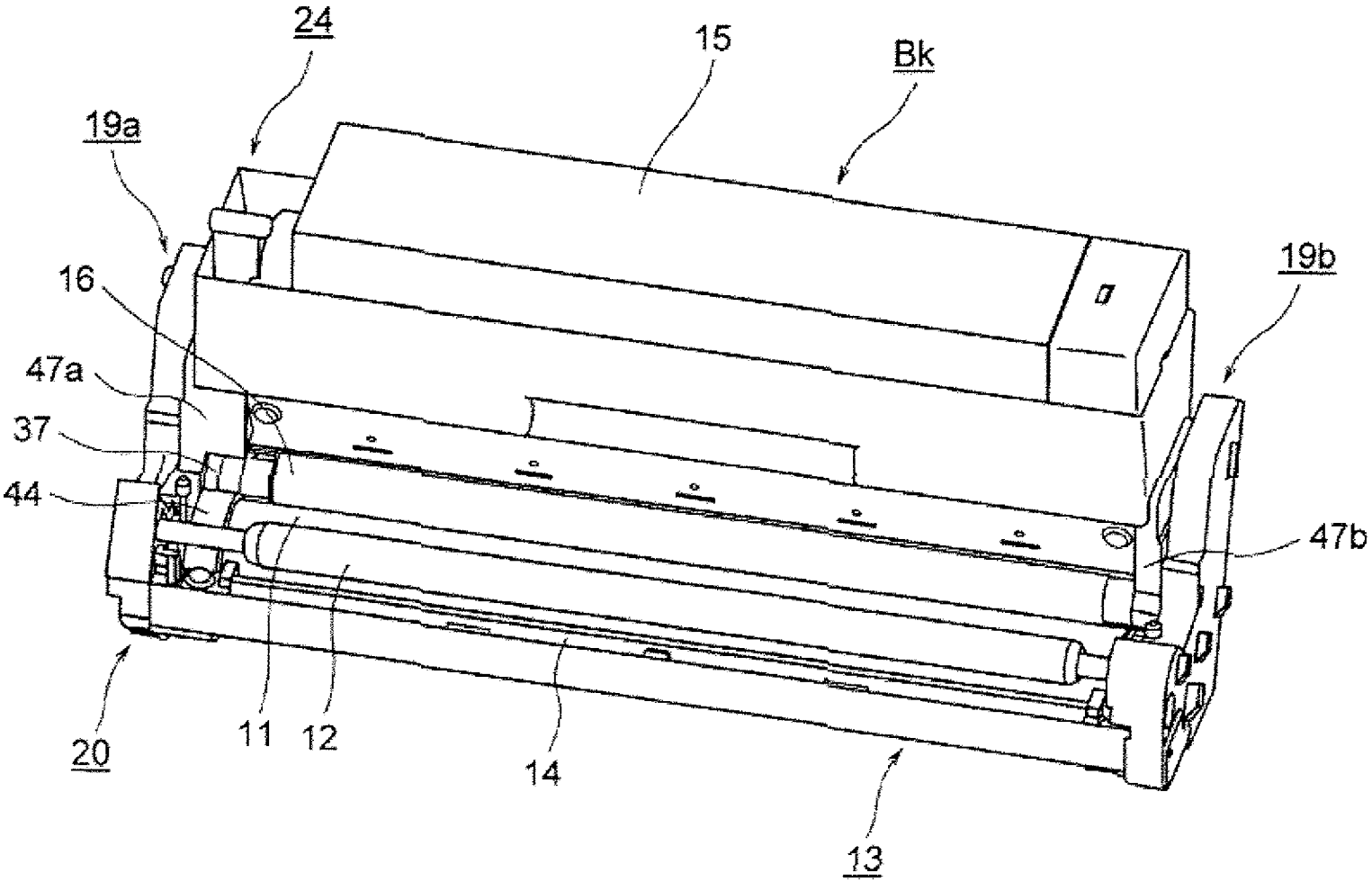
FIG. 3 is a perspective view of an image forming unit according to a first disclosed embodiment.
Figure 4:
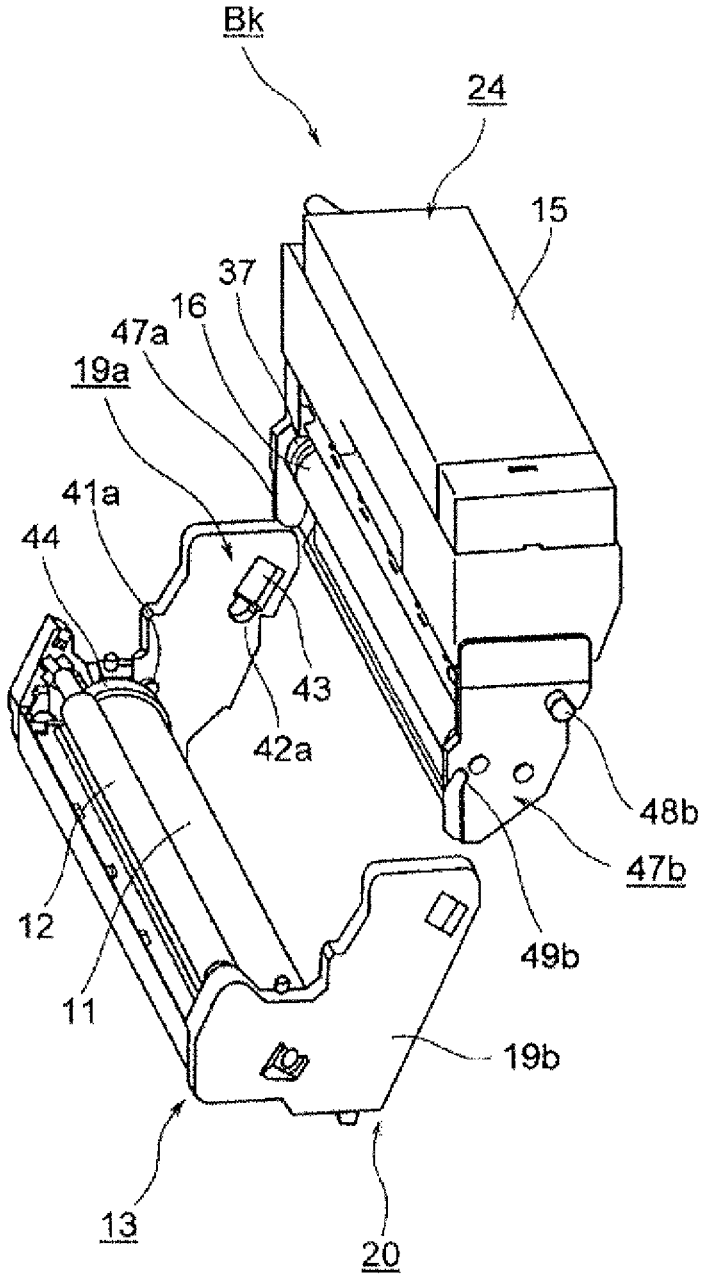
FIG. 4 is a first exploded perspective view of an image forming unit according to a first disclosed embodiment.
Figure 5:
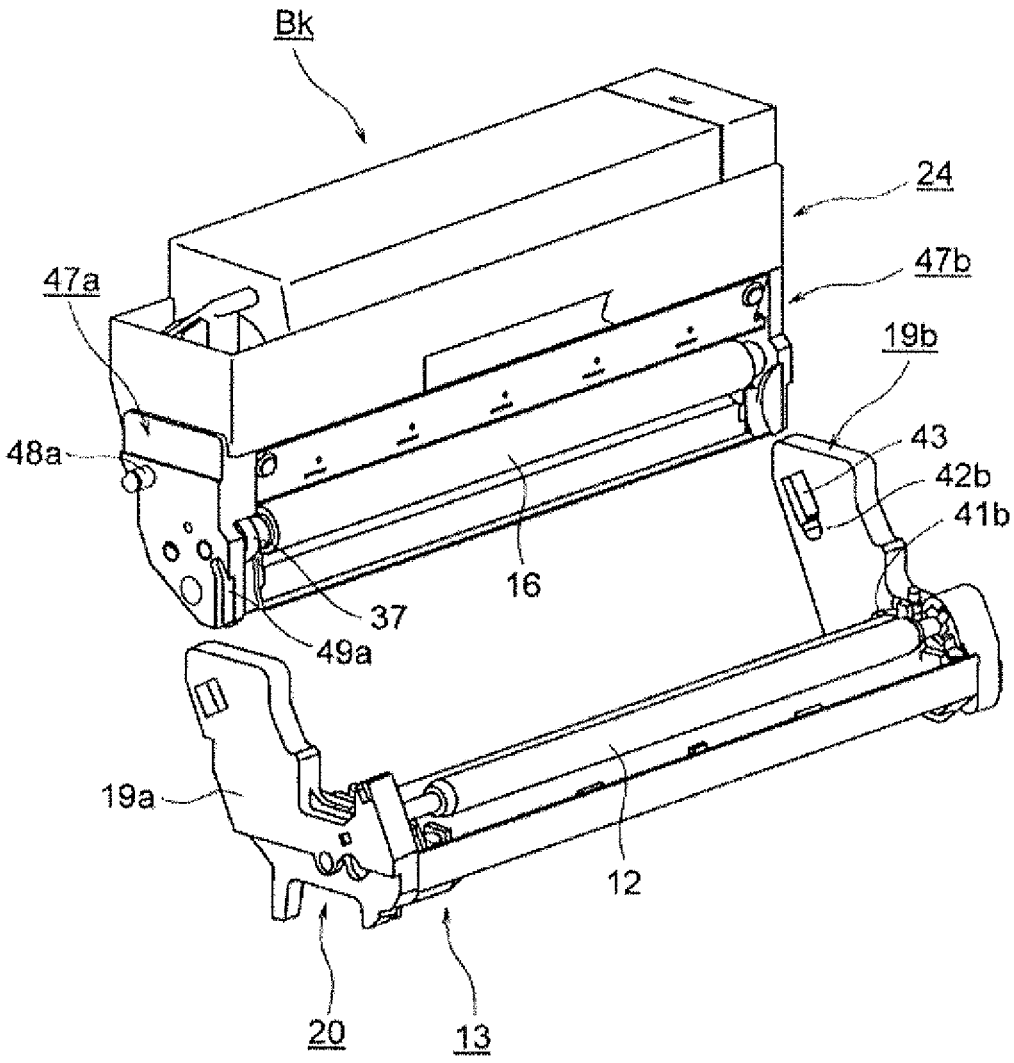
FIG. 5 is a second exploded perspective view of an image forming unit according to a first disclosed embodiment.
Figure 6:
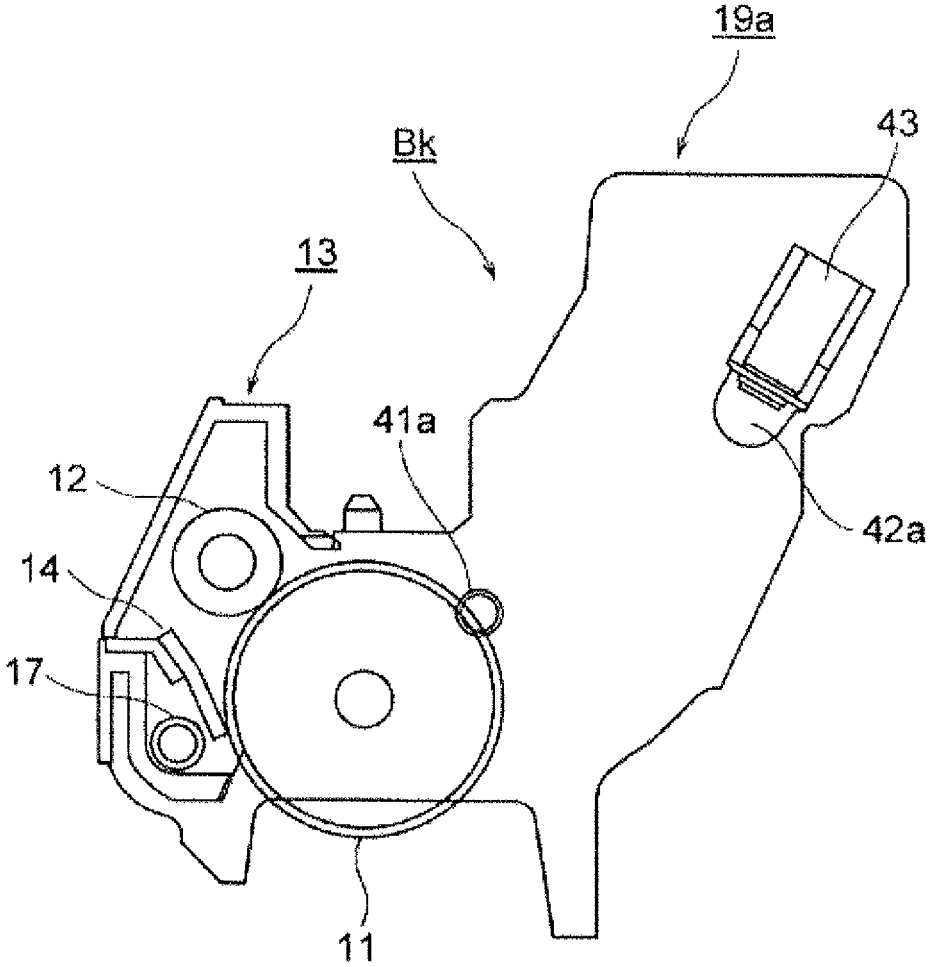
FIG. 6 is a sectional view of a drum unit according to a first disclosed embodiment.
Figure 7:
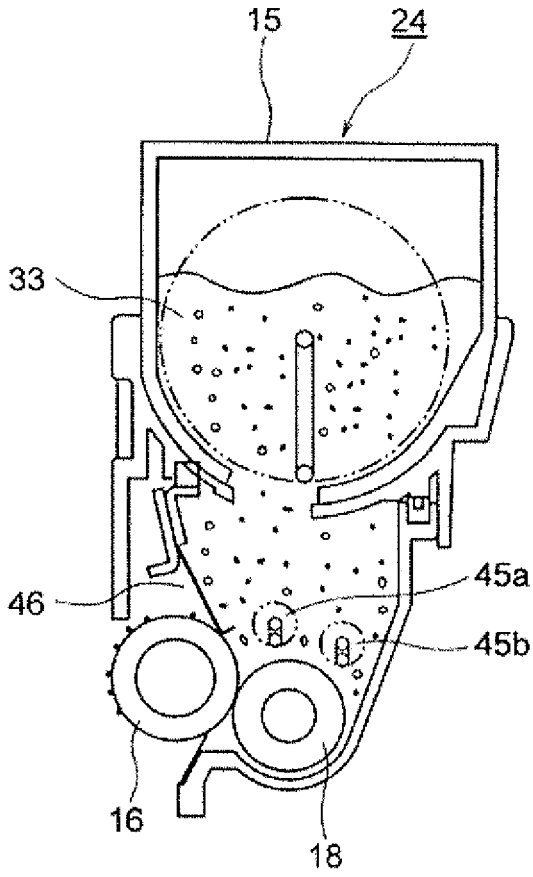
FIG. 7 is a sectional view of main parts of an image forming unit according to a first disclosed embodiment.

FIG. 3 is a perspective view of an image forming unit according to a first disclosed embodiment. FIG. 4 is a first exploded perspective view of the image forming unit according to the first disclosed embodiment. FIG. 5 is a second exploded perspective view of the image forming unit according to the first disclosed embodiment. FIG. 6 is a sectional view of a drum unit according to the first disclosed embodiment. FIG. 7 is a sectional view of main parts of the image forming unit according to the first disclosed embodiment.

As shown in these figures, the ID unit Bk has a drum unit 13 as a first unit, and a developing unit 24 as a second unit that is detachable from the drum unit 13. The drum unit 13 has the photoreceptor drum 11, the charge roller 12, a cleaning blade 14, a carrying spiral 17, and side plates 19*a* and 19*b* that hold the above mentioned structures. The cleaning blade 14 operates as a cleaning part that scrapes remaining toner from the surface of the photoreceptor drum 11 after toner transfer. The carrying spiral 17 operates as a carrying part that carries waste toner as waste developer scraped by the cleaning blade 14. The side plates 19*a* and 19*b* have cylindrical projection parts 41*a* and 41*b*, groove parts 42*a* and 42*b*, and a bias spring 43. The cylindrical projection parts 41*a* and 41*b* operate as first engaging components and are for attaching the developing unit 24 to the drum unit 13; the groove parts 42*a* and 42*b* operate as third engaging components; and the bias spring 43 operates as a biasing part that biases the developing unit 24 toward the drum unit 13.

The developing unit 24 has the developing roller 16, the toner cartridge 15, agitating parts 45*a* and 45*b* that agitate toner 33 supplied from the toner cartridge 15, the toner supplying roller 18 that supplies the toner 33 to the developing roller 16, the developing blade 46 that regulates the thickness of a toner layer on the developing roller 16, and side plates 47*a* and 47*b* that hold the above mentioned structures in the both ends. The agitating parts 45*a* and 45*b* operate to agitate toner 33 supplied from the toner cartridge 15; the toner supplying roller 18 operates to supply the toner 33 to the developing roller 16; and the developing blade 46 operates to regulate the thickness of a toner layer on the developing roller 16. The side plates 47*a* and 47*b* have cylindrical projection parts 48*a* and 48*b*, operating as fourth engaging components that are for attaching the developing unit 24 to the drum unit 13 and groove parts 49*a* and 49*b*, operating as third engaging components.

As shown in FIGS. 3 and 4, the photoreceptor drum 11 is rotatably supported by the side plates 19*a* and 19*b* and serves as a first rotating body. The photoreceptor drum 11 rotates when the rotation of a motor (not shown) as a drive part is transmitted to a drum gear 44, operating as a first gear, located in one end. The developing roller 16 is rotatably supported by the side plates 47*a* and 47*b* and serves as a second rotating body. The developing roller 16 rotates when the rotation of the photoreceptor drum 11 is transmitted to a developing roller gear 37, operating as a second gear, that meshes with the drum gear 44 and is located in one end.

Next, a rotation transmitting system of the ID unit Bk is explained.

Figure 1:
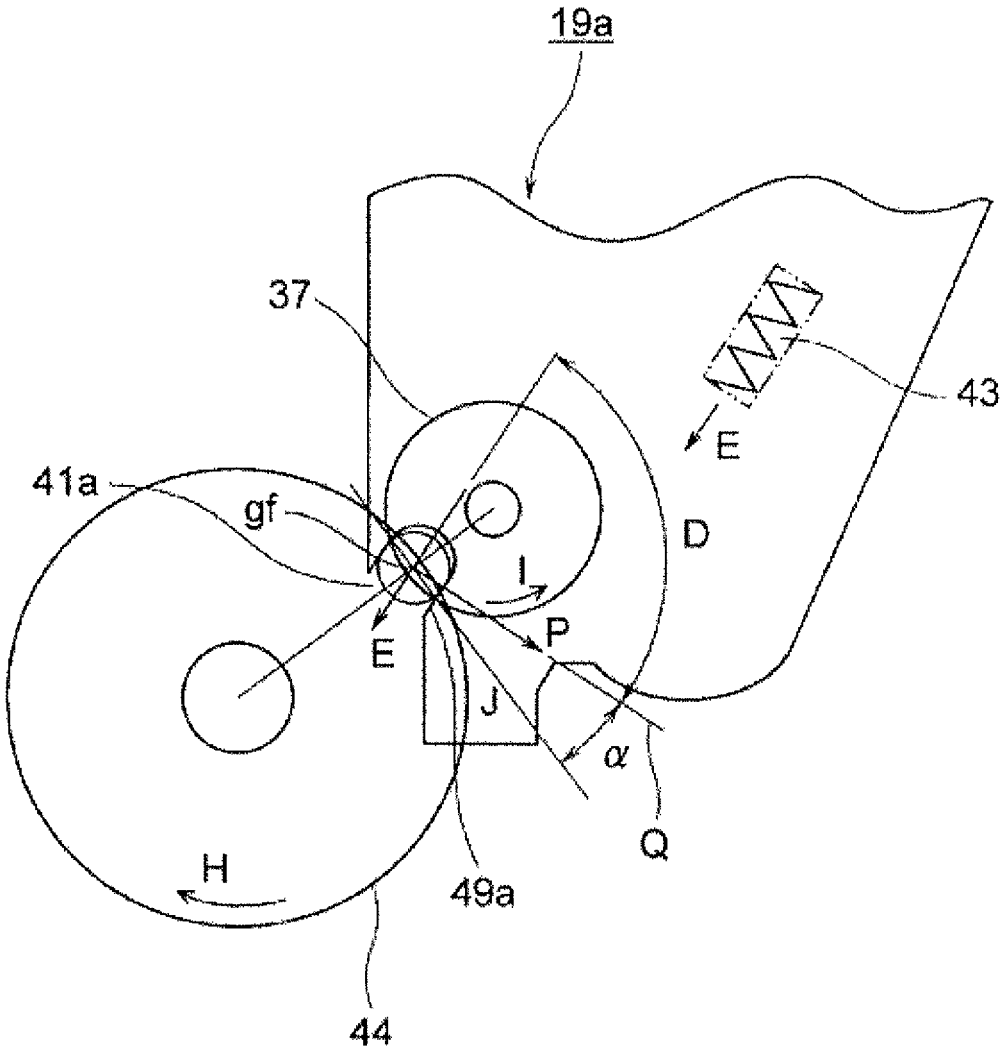
FIG. 1 is a first schematic view of a relationship between a drum gear and a developing roller gear according to a first disclosed embodiment.
Figure 8:
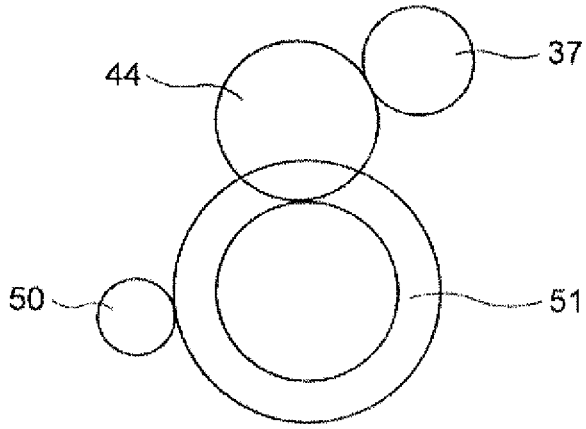
FIG. 8 is a schematic view of a rotation transmitting system of an image forming unit according to a first disclosed embodiment.
Figure 9:
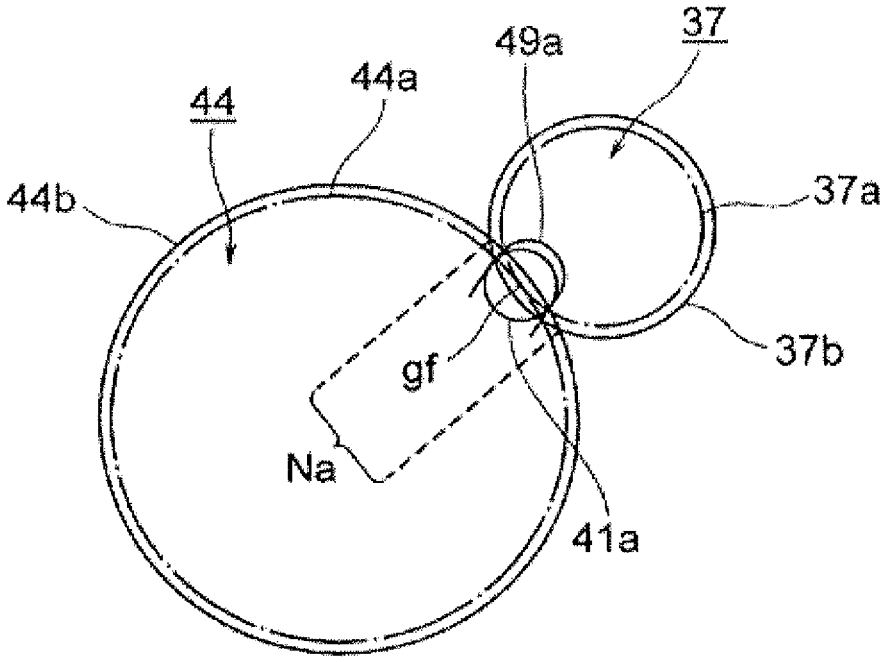
FIG. 9 is a second schematic view of relationship between a drum gear and a developing roller gear according to a first disclosed embodiment.

FIG. 1 is a first schematic view of relationship between the drum gear 44 and the developing roller gear 37 according to the first disclosed embodiment. FIG. 8 is a schematic view of the rotation transmitting system of an image forming unit according to the first disclosed embodiment. FIG. 9 is a second schematic view of relationship between the drum gear 44 and the developing roller gear according to the first disclosed embodiment.

In FIG. 8, the reference numeral 37 represents the developing roller gear, the reference numeral 44 represents the drum gear, the reference numeral 50 represents a motor gear that is attached to an output shaft of the motor, and the reference numeral 51 represents a reduction gear that slows down the rotation speed of the motor and transmits the rotation to the drum gear 44.

As shown in FIG. 3, when the developing unit 24 is attached to the drum unit 13, the developing roller gear 37 meshes with the drum gear 44, so that the developing roller 16 rotates at a certain rotation speed that has a certain speed difference compared to the rotation speed of the photoreceptor drum 11. In FIG. 1, the rotation direction of the drum gear 44 is in the direction of arrow H. The rotation direction of the developing roller gear 37 is in the direction of arrow I. When the developing unit 24 is attached to the drum unit 13, the projection parts 41*a* and 41*b* engage with the groove parts 49*a* and 49*b*, respectively. As shown in FIGS. 1 and 9, the engagement position that indicates the position of engagement is located in the vicinity of the position where the drum gear 44 meshes with the developing gear 37. Namely, the engagement position is located within the area Na where the outer circumference circle 37*b* of the developing roller gear 37 and the outer circumference circle 44*b* of the drum gear 44 overlap each other with the point of contact gf between the pitch circle 37*a* of the developing roller gear 37 and the pitch circle 44*a* of the drum gear 44 being the center, i.e., within the area where the developing gear 37 meshes with the drum gear 44.

The projection parts 41*a* and 41*b* are in a cylindrical shape. When the direction of the mesh pressure angle in the point of contact gf between the teeth of the drum gear 44 and the developing roller gear 37 is in the direction of arrow E (i.e., the E direction), operating as a biasing direction, the groove parts 49*a* and 49*b* are U-shaped along the E direction. When the direction of the tangent line of the pitch circles 37*a* and 44*a* is the direction of line J (i.e., the J direction), and when a direction perpendicular to the E direction is the direction of line Q (i.e., the Q direction), operating as a driving direction, an angle between the J and Q directions is referred to as the mesh pressure angle $\alpha$. Note that the angle D between the E and Q directions is 90 degrees.

The developing unit 24 is biased in the E direction by the bias spring 43 that is located in the drum unit 13. Therefore, the developing roller 16 uniformly contacts and presses the photoreceptor drum 11 in the shaft direction of the developing roller 16.

In the disclosed embodiment, the drive force P is generated in the Q direction, which is deviated from the J direction by the mesh pressure angle $\alpha$ with respect to the rotation of the drum gear 44. However, when an angle between the direction E of the biasing force and the direction of the drive force P that is caused by the meshing of the drum gear 44 and the developing roller gear 37 is very different from 90° (for example, outside of a range from 85° to 95°), the drive force P is generated in one end where the drum gear 44 and the developing roller gear 37 are located and is not generated in another end of the developing roller 16. Therefore, the operation of the disclosed embodiment is deteriorated. In such a case, the developing roller 16 will not uniformly contact and press the photoreceptor drum 11.

Because the projection parts 41*a* and 41*b* are in the cylindrical shape and the groove parts 49*a* and 49*b* are U-shaped, when the projection parts 41*a* and 41*b* and the groove parts 49*a* and 49*b* are engaged, respectively, the groove parts 49*a* and 49*b* regulates the movement of the projection parts 41*a* and 41*b* in the Q direction. The groove parts 49*a* and 49*b* can therefore receive the drive force P. Because the projection parts 41*a* and 41*b* can move in the E direction along the groove parts 49*a* and 49*b*, and the developing unit 24 is biased to the drum unit 13 in the E direction by the bias spring 43, the photoreceptor drum 11 and the developing roller 16 are easily and uniformly contacted and pressed against each other in the shaft directions.

Next, movements of attaching the developing unit 24 to the drum unit 13 are explained.

Figure 11:
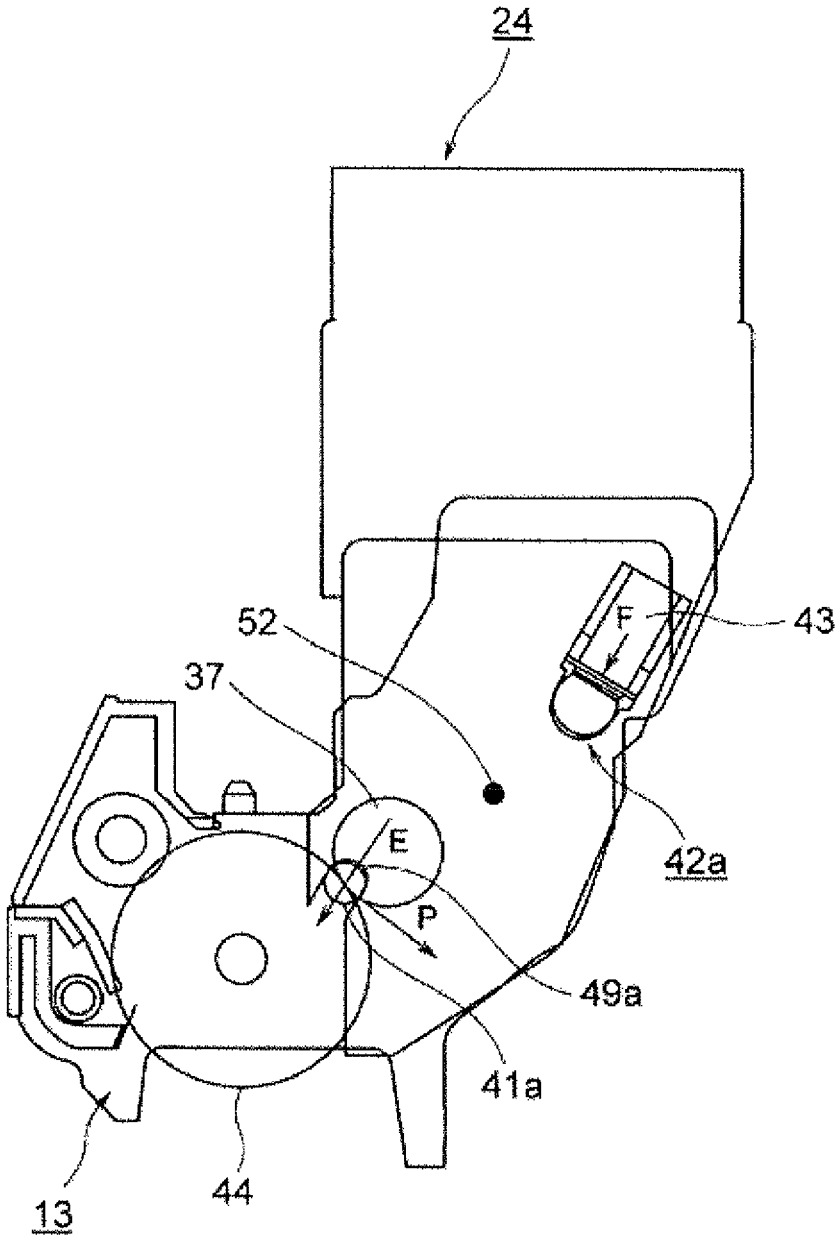
FIG. 11 is a second schematic view of movement when a developing unit is attached to a drum unit according to a first disclosed embodiment.
Figure 12:
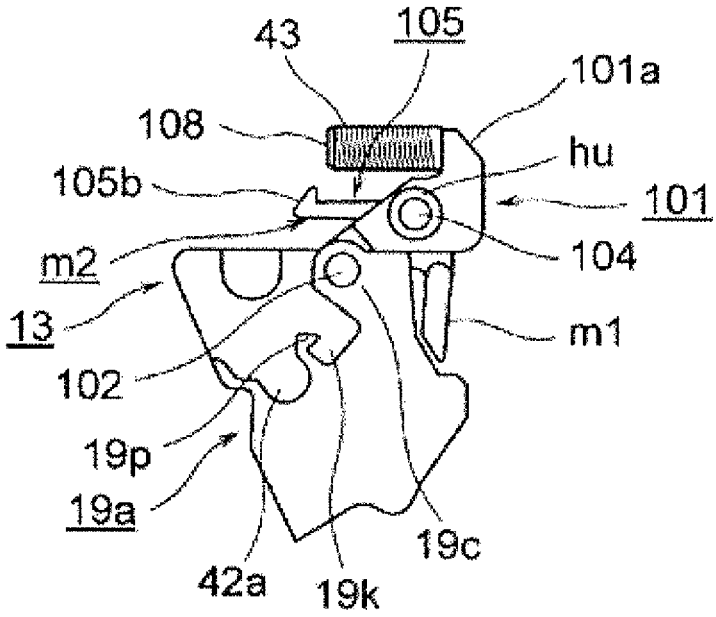
FIG. 12 is a third schematic view of movement when a developing unit is attached to a drum unit according to a first disclosed embodiment.
Figure 13:
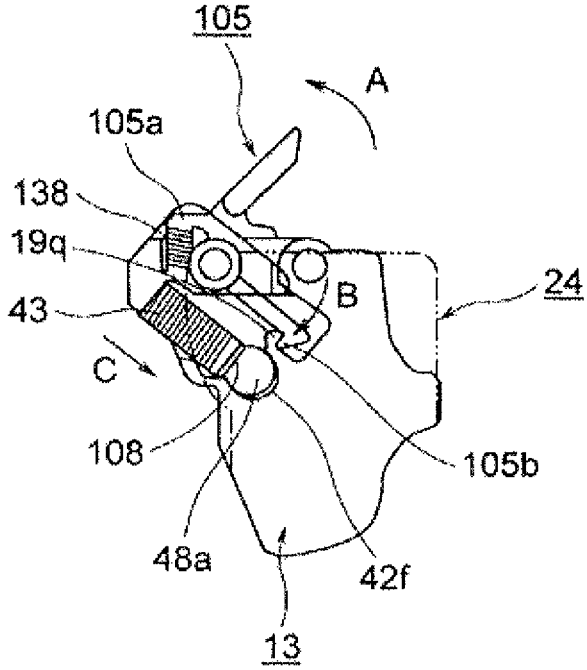
FIG. 13 is a fourth schematic view of movement when a developing unit is attached to a drum unit according to a first disclosed embodiment.

FIG. 10 is a first schematic view of movement when the developing unit is attached to the drum unit according to the first disclosed embodiment. FIG. 11 is a second schematic view of movement when the developing unit is attached to the drum unit according to the first disclosed embodiment. FIG. 12 is a third schematic view of movement when the developing unit is attached to the drum unit according to the first disclosed embodiment. FIG. 13 is a fourth schematic view of movement when the developing unit is attached to the drum unit according to the first disclosed embodiment.

As shown in FIGS. 10-13, when the developing unit 24 is attached to the drum unit 13, the projection parts 41*a*, 41*b*, 48*a*, and 48*b* are engaged with the groove parts 49*a*, 49*b*, 42*a*, and 42*b*, respectively.

The engagement position between the projection parts 41*a* and 41*b* and the groove parts 49*a* and 49*b* is located in the vicinity of the area where the developing gear 37 meshes with the drum gear 44, as discussed above. The engagement positions between the projection parts 48*a*, 48*b* and the groove parts 42*a*, 42*b* are located on an opposite side from the engagement positions between the projection parts 41*a*, 41*b* and the groove parts 49*a*, 49*b* with respect to the perpendicular line that passes through the center of gravity 52 of the developing unit 24. A main engaging part, operating as a first engaging part, is configured with the projection parts 41*a* and 41*b* and the groove parts 49*a* and 49*b*. A sub-engaging part, operating as a second engaging part, is configured with the projection parts 48*a* and 48*b* and the groove parts 42*a* and 42*b*.

As discussed above, when the direction of the mesh pressure angle in the point of contact gf between the teeth of the drum gear 44 and the developing roller gear 37 is in the E direction, the groove parts 49*a* and 49*b* are U-shaped along the E direction. The groove parts 49*a* and 49*b* regulate the movement of the projection parts 41*a* and 41*b* in the Q direction. As a result, the drive force P is negated by the groove parts 49*a* and 49*b*.

The groove parts 42*a* and 42*b* are parallel to the groove parts 49*a* and 49*b* and are U-shaped. The projection parts 48*a* and 48*b* located at the developing unit 24 are in a cylindrical shape and have a plane surface "sa" that is elongated in a direction perpendicular to the groove parts 42*a* and 42*b*. Therefore, when the projection parts 48*a* and 48*b* and the groove parts 42*a* and 42*b* are engaged, respectively, the groove parts 42*a* and 42*b* regulates the movement of the projection parts 48*a* and 48*b* in the Q direction. The groove parts 42*a* and 42*b* can receive the drive force P. Because the projection parts 48*a* and 48*b* can move in the E direction along the groove parts 42*a* and 42*b*, and the developing unit 24 is biased in the E direction to the drum unit 13 by the bias spring 43, the photoreceptor drum 11 and the developing roller 16 are easily and uniformly contacted and pressed against each other in the shaft directions.

When the bottom part of the groove parts 42*a* and 42*b* is defined as the bottom part 42*f*, and when the space part between the bottom part 42*f* and the tip of the bias spring 43 is defined as the space part 42*g*, the relationship between L11, which is the longest length of the projection parts 48*a* and 48*b* in the E direction, and L12, which is the longest length of the space parts 42*g* in the E direction, is set as L11>L12. Because the relationship between L11 and L12 is set as discussed above, when the projection parts 48*a* and 48*b* are inserted into the groove parts 42*a* and 42*b*, a biasing force F of the bias spring 43 is certainly applied to the plane surface sa.

With the engagements between the projection parts 41*a*, 41*b*, 48*a*, and 48*b* with the groove parts 49*a*, 49*b*, 42*a*, and 42*b*, respectively, the developing unit 24 can be stably attached to the drum unit 13 in the E direction, which is perpendicular to the Q direction, such that the drive force P is negated.

When the developing unit 24 is attached to the drum unit 13, a holder 101 is swingably provided to a post 102 to fix the developing unit 24 into the drum unit 13 as shown in FIGS. 12 and 13. In this case, the holders 101 are provided at the side plates 19*a* and 19*b*. Because the structure of each holder 101 is same, only the holder 101 at the side plate 19*a* is described.

A post 104 is fixed to the holder 101. A lock lever 105, operating as a locking mechanism, is swingably provided to the holder 101, with the post 104 serving as a point of support.

A depression part 108 is provided at a tip part 101*a* of the holder 101. The bias spring 43 elastically surrounds the depression part 108. An engagement part (not shown) is provided at the depression part 108. The bias spring 43 latches the engagement part so that the bias spring 43 does not come off from the depression part 108. A compression spring 138, operating as a lock mechanism bias part, is located between a pressing part 105*a* of the lock lever 105 and the holder 101 so that the lock lever 105 is biased in the lock direction.

The post 102 is fixed to a support part 19*c* of the side plate 19*a*. The holder 101 is swingably provided to the side plate 19*a* as the post 102 is a point of support. Similarly, the post 104 is fixed to the holder 101. The lock lever 105 is swingably provided to the holder 101 as the post 104 is a point of support.

As shown in FIG. 12, in the initial state of the drum unit 13, the holder 101 and the lock lever 105 are in the release state, and the bias spring 43 and the depression part 108 are in the elongated state. Therefore, the biasing force is not generated. When the depression part 108 is in the elongated state, the lock lever is projected parallel to the depression part 108 and the bias spring 43.

The lock lever 105 has a lever m1, an arm m2, and a pressing part 105*a*. The level m1, operating as a handle part, is projected from a hub part hu that surrounds the post 104; the arm m2 is projected in the perpendicular direction to the lever m1; and the pressing part 105*a* is projected in the vicinity of the hub part hu. A hook 105*b*, operating as an engaging component, is formed at the tip of the arm m2.

The side plate 19*a* has a receiving part 19*k* adjacent to the groove part 42*a*, a projection part 19*p* that is projected between the groove part 42*a* and the receiving part 19*k* in the upper direction, and a hook 19*q* that is formed at the tip of the projection part 19*p* as a component to be engaged.

After the drum unit 13 is attached to the developing unit 24, when the holder 101 rotates in the direction of arrow A (the A direction), the tip of the bias spring 43 contacts the projection part 48*a*. At this point, the projection part 48*a* is biased toward the bottom part 42*f* of the groove 42*a* by a certain biasing force F of the bias spring 43. The arm m2 contacts the projection part 19*p*.

When the holder 101 further rotates in direction A, because the lock lever 105 is swingably provided to the holder 101, the rotation of the holder 101 is regulated under the situation where the holder contacts the projection part 19*p*. As a result, the depression part 108 is compressed.

When the holder reaches a certain position, the hook 105*b* goes into the receiving part 19*k*, passing the hook 19*q*. As a result, the regulation for the rotation of the lock lever 105 is released. The lock lever 105 rotates in the direction of arrow B (the B direction) by the biasing force, and then the hook 105*b* is engaged with the hook 19*q*.

Finally, the lock lever 105 is locked while the developing unit 24 is attached to the drum unit 13.

In this disclosed embodiment, the angle D is set to 90 degrees. However, when misalignment occurs, for example, at the point of contact gf where the drum gear 44 and the developing roller gear 37 are meshed, at the engagement positions between the projection parts 48*a* and 48*b* and the groove parts 42*a* and 42*b*, and/or at the engagement positions between the projection parts 41*a* and 41*b* and the groove parts 49*a* and 49*b*, there is a possibility that some variations for the angle D may occur.

Experiments in which images were formed (i.e., printed) under conditions that had several different angles D were performed to determine whether the image quality was decreased or not. The determination results are shown in Table 1 below.

TABLE 1

| Angle D (°) | 80 | 82.5 | 85 | 87.5 | 90 | 92.5 | 95 | 97.5 | 100 |
|---|---|---|---|---|---|---|---|---|---|
| Jitter | x | Δ | ○ | ○ | ○ | ○ | ○ | Δ | x |
| Spot | x | x | ○ | ○ | ○ | ○ | ○ | ○ | ○ |
| Blur | ○ | ○ | ○ | ○ | ○ | ○ | ○ | x | x |

Expected factors for decreasing of the image quality due to the occurrence of the misalignment of the positions are jitter, spot, blur, and so on. Jitter is uneven image quality in the lateral direction (i.e., scan direction) and often occurs in an image with a pitch width that is equal to one tooth of a gear. When contacting and pressing status between the photoreceptor drum 11 and the developing roller 16 are not enough, spots occur because the toner 33 does not adhere on the area in which an electrostatic latent image is formed. In the experiments, there is a possibility that a spot occurs in the ends of the photoreceptor drum 11 and the developing roller 16. When contacting and pressing status between the photoreceptor drum 11 and the developing roller 16 are excessively strong, a blur may occur in the area in which an electrostatic latent image is not formed through adhering the toner 33 on the white background part.

In these experiments, a certain number of sheets was printed with several different angles for D: 80°, 82.5°, 85°, 87.5°, 90°, 92.5°, 95°, 97.5°, and 100°. Whether the decrease of the image quality occurred or not was determined. An A3 size sheet that is the largest sheet applicable for a printer of the experiments was used. 25% duty printing in which some dots are uniformly pulled from the solid printing was performed.

If, after the certain number of sheets was printed, jitters, spots, and blurs did not occur on any of the sheets, the mark "○" was used; if jitters, spots, and blurs occurred on all of the sheets, the mark "x" was used; and if jitters, spots, and blurs occurred on some, but not all, of the sheets, the mark "Δ" was used.

When the angle D was larger, a component of force of the drive force P that was based on the meshing of the drum gear 44 and the developing roller gear 37 was applied in the direction in which the pressing force between the photoreceptor drum 11 and the developing roller 16 was increased, so that the jitters and blurs occurred. When the angle D was smaller, the component of force of the drive force P that was based on the meshing of the drum gear 44 and the developing roller gear 37 was applied in the direction in which the pressing force between the photoreceptor drum 11 and the developing roller 16 was decreased, so that the jitters and spots occurred. As a result, in these experiments, it was understood that when the angle D is in the following range, $85° \leqq D \leqq 95°$, the jitters, spots and blurs did not occur, and the image quality was not decreased.

In the present disclosed embodiment, as discussed above, when the developing unit 24 is attached to the drum unit 13, the photoreceptor drum 11 and the developing roller 16 are easily and uniformly contacted and pressed to each other in the shaft directions because of the following features: (1) the projection parts 41*a* and 41*b*, and the groove parts 49*a* and 49*b* are located in the vicinity of the point of contact gf in which the drum gear 44 and the developing roller gear 37 are meshed; (2) the grooves 42*a*, 42*b*, 49*a*, and 49*b* receive the drive force P that is generated through the meshing of the drum gear 44 and the developing roller gear 37; (3) the developing unit 24 is provided to be movable in the E direction; and (4) the developing unit 24 is biased toward the drum unit 13 by the bias spring 43.

Because the position of the developing roller 16 is changed and adjusted while the pressing force between the photoreceptor drum 11 and the developing roller 16 is measured, workability for contacting and pressing between the photoreceptor drum 11 and the developing roller 16 with the uniform pressing force is improved.

Next, a second disclosed embodiment is explained. Structures that have the same structures as the first disclosed embodiment are assigned the same reference numerals. The effects of the first disclosed embodiment are incorporated herein for an effect based on the same structures.

Figure 14:
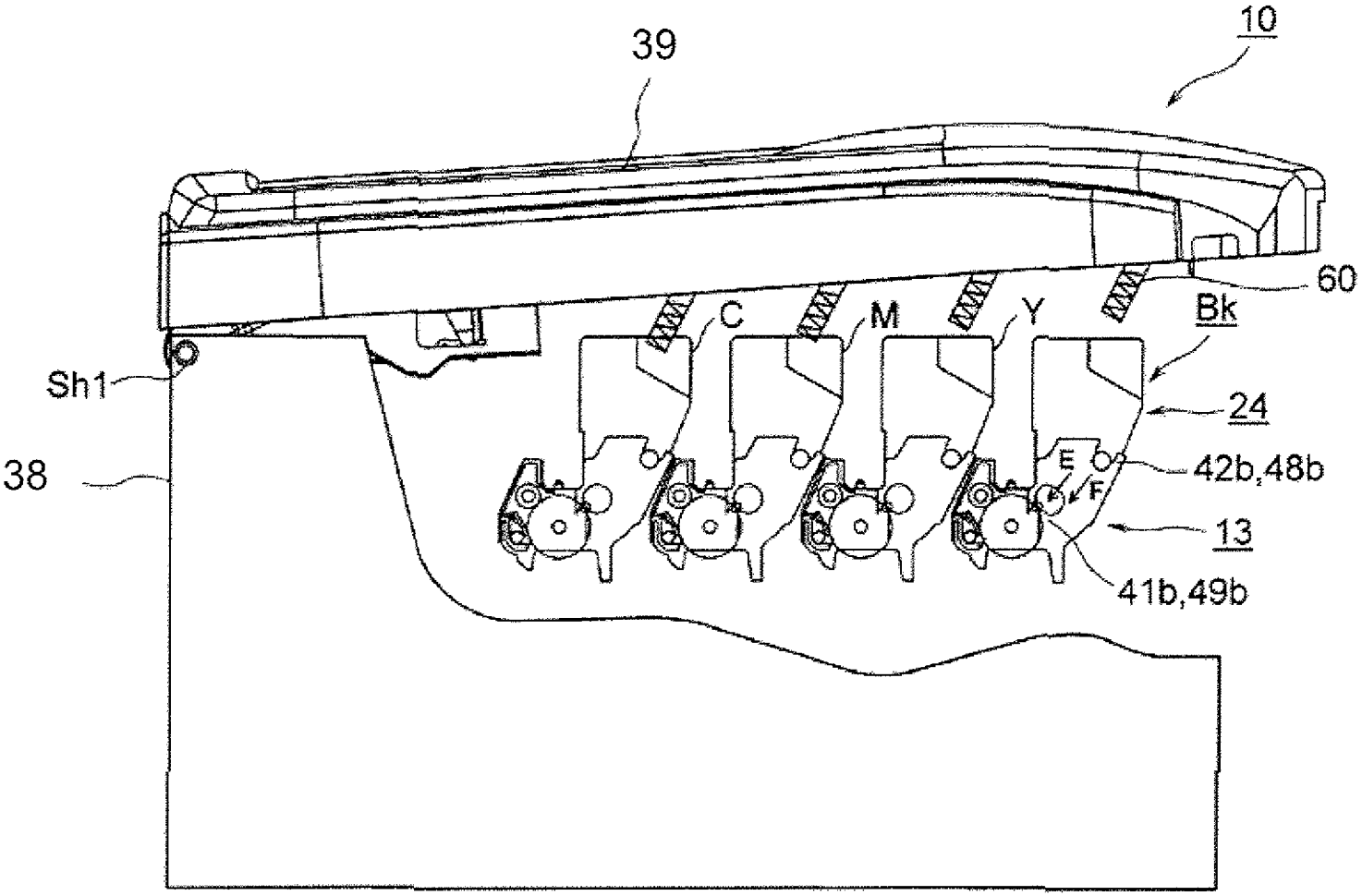
FIG. 14 is a first schematic view of a printer according to a second disclosed embodiment.
Figure 15:
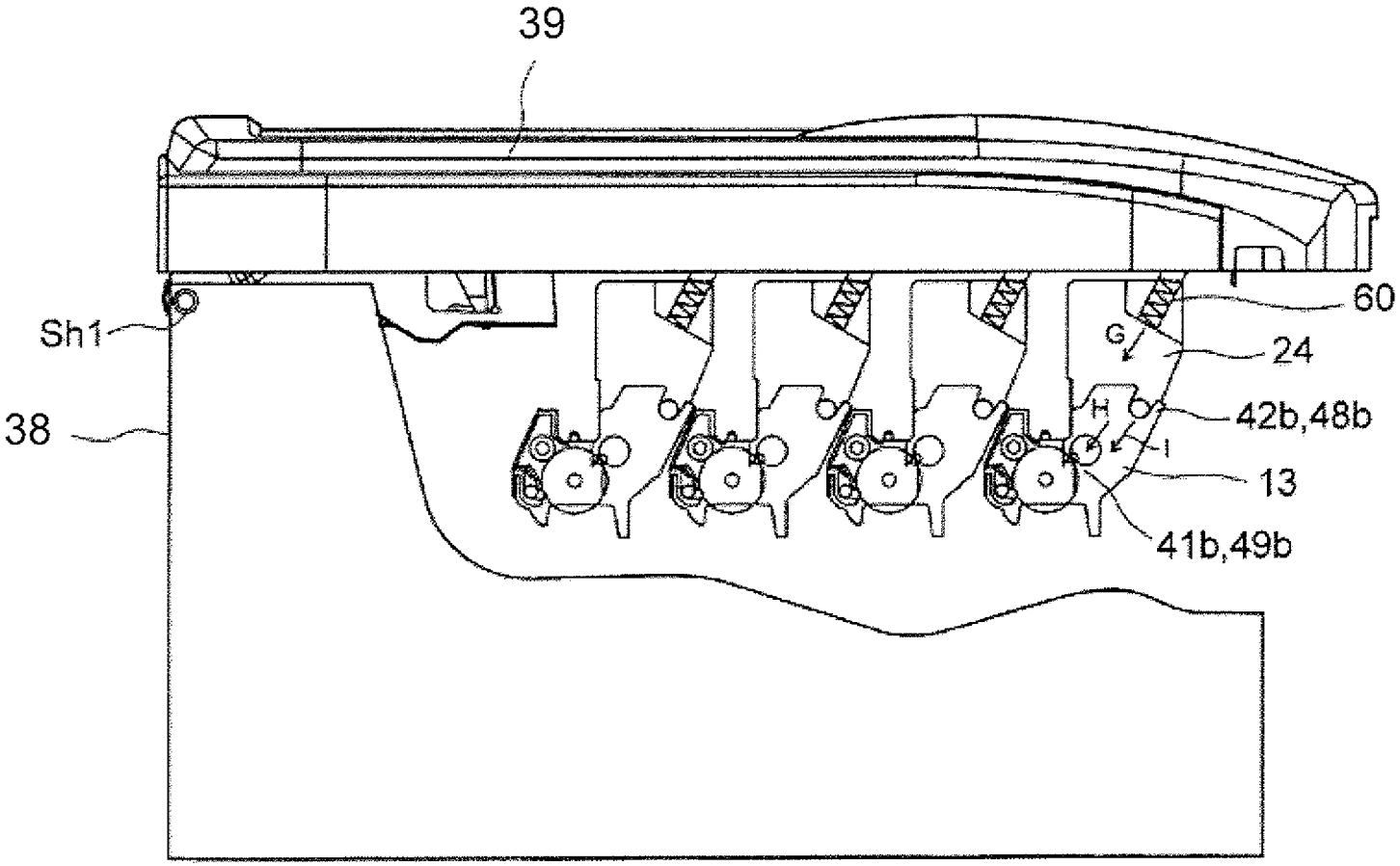
FIG. 15 is a second schematic view of a printer according to a second disclosed embodiment.

FIG. 14 is a first schematic view of a printer according to a second disclosed embodiment. FIG. 15 is a second schematic view of the printer according to the second disclosed embodiment.

The reference numeral 10 is a main body. Bk, Y, M, and C are image forming units (ID units). The reference numeral 13 is a drum unit, operating as a first unit. The reference numeral 24 is a developing unit, operating as a second unit. The reference numerals 41*b* and 48*b* are cylindrical (or mostly cylindrical) projection parts, operating as first and fourth engaging components, respectively. The reference numerals 42*b* and 49*b* are groove parts, operating as second and fourth engaging components, respectively. A main engaging part, operating as a first engaging part, is configured with the projection part 41*b* and the groove part 49*b*. A sub-engaging part, operating as a second engaging part, is configured with the projection part 48*b* and the groove part 42*b*.

A bias spring 60, operating as a biasing part that biases the developing unit 24 toward the drum unit 13 with a certain biasing force F, is provided at an upper cover 39. When the upper cover is closed, a lower end of the bias spring 60 contacts and presses a certain area, i.e., the vicinity of an upper end of the developing unit 24 in this disclosed embodiment, so that the developing unit 24 is pressed to the drum unit 13.

A biasing direction for the developing unit 24 by the bias spring is the G direction. A direction in which the projection part 41*b* is provided to be movable with respect to the groove part 49*b* is the H direction. A direction in which the projection part 48*b* is provided to be movable with respect to the groove part 42*b* is the I direction. The G direction is parallel to the H and I directions. In the first disclosed embodiment, the G direction is perpendicular to the Q direction in which the drive force P is generated.

When the upper cover 39 is open, the bias spring 60 is moved with the upper cover 38 in the opening direction of the upper cover 39, so that the bias by the bias spring 60 is released. Under the situation discussed above, the developing unit 24 is taken out in the direction opposite to the H and I directions.

In this disclosed embodiment, the bias spring 60 is located at the upper cover 39. When the upper cover 39 is open, the bias by the bias spring 60 is released. Therefore, when the developing unit 24 is replaced, the detachable operation for the developing unit 24 can be simplified.

Next, a third disclosed embodiment is explained. Structures that have the same structures of the first and second disclosed embodiments are assigned the same reference numerals. The effects of the first and second disclosed embodiments are incorporated herein for an effect based on the same structures.

Figure 16:
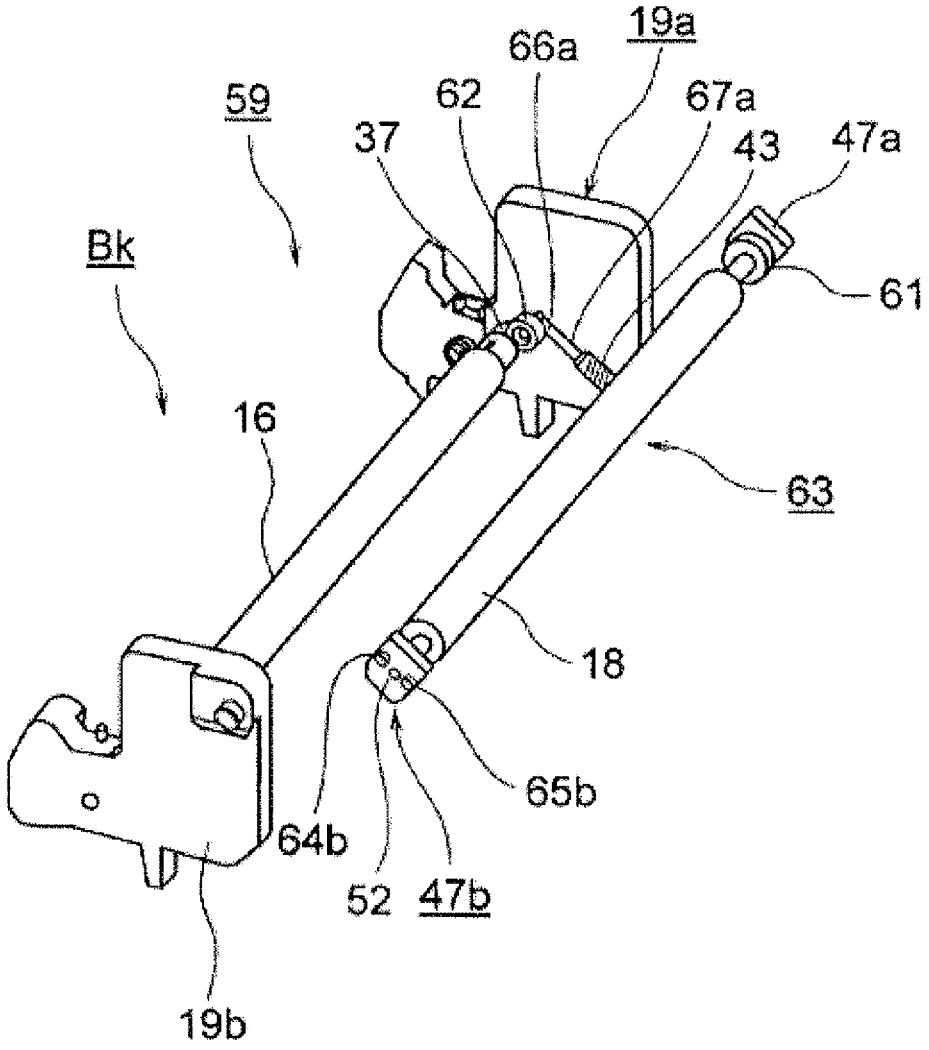
FIG. 16 is a first exploded perspective view of an image forming unit according to a third disclosed embodiment.
Figure 17:
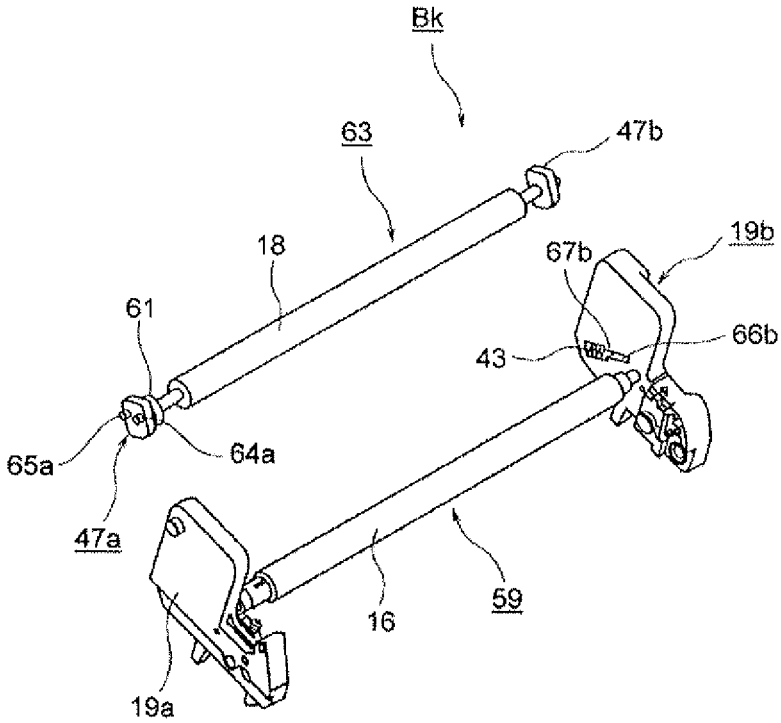
FIG. 17 is a second exploded perspective view of an image forming unit according to a third disclosed embodiment.
Figure 18:
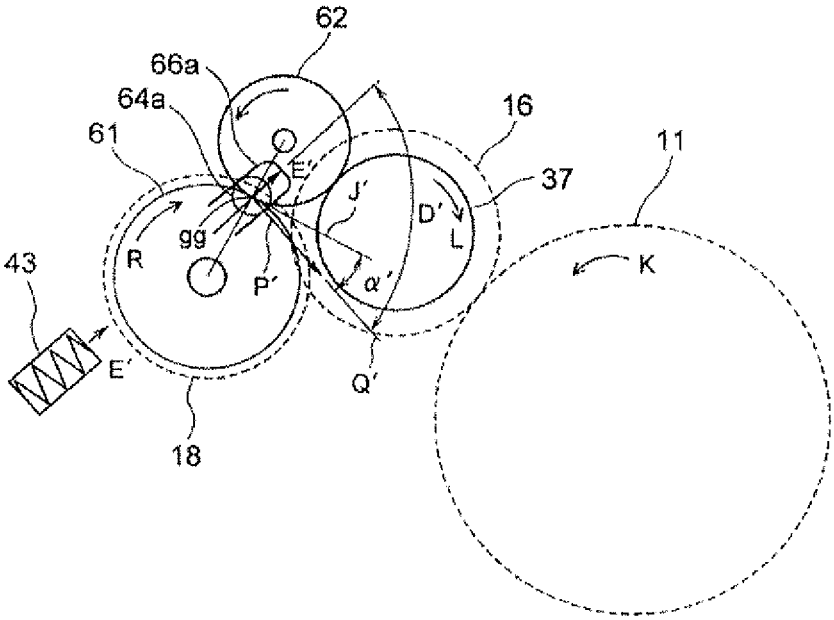
FIG. 18 is a schematic view of relationship among a developing roller gear, a driven gear, and a toner supplying roller gear according to a third disclosed embodiment.
Figure 19:
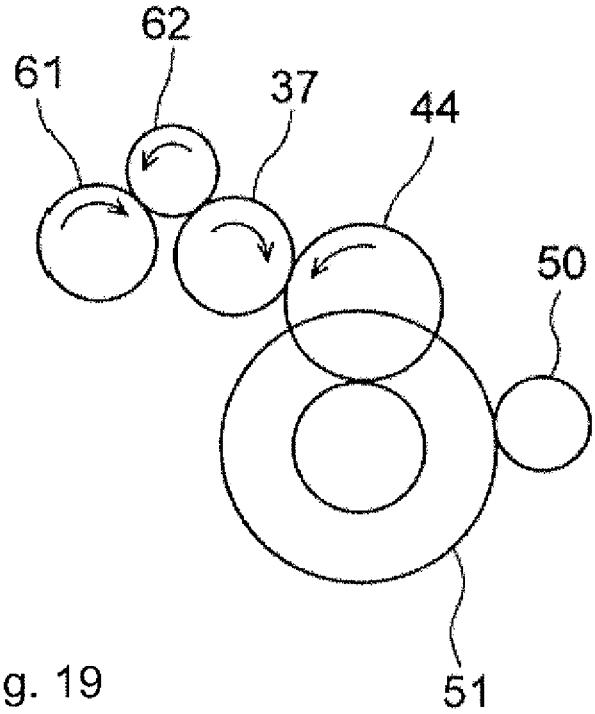
FIG. 19 is a schematic view of a rotation transmitting system of an image forming unit according to a third disclosed embodiment.
Figure 20:
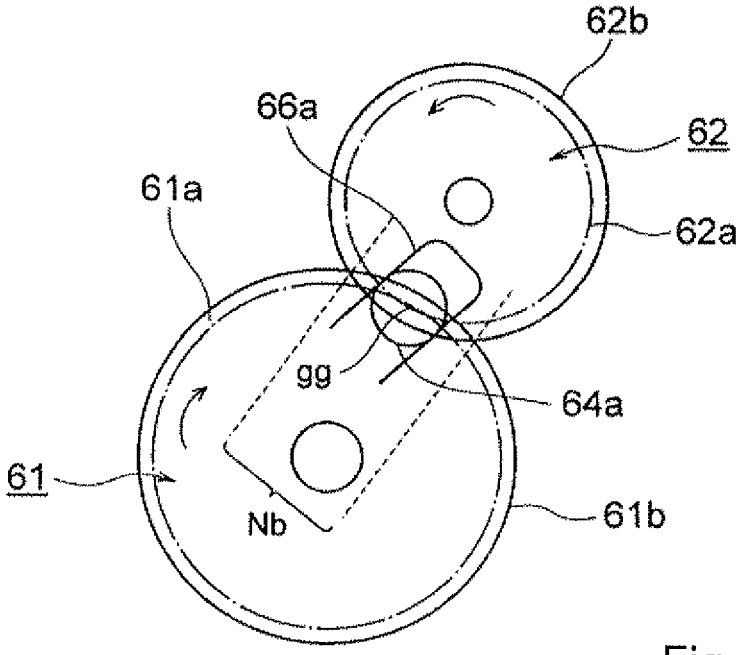
FIG. 20 is a schematic view of relationship between a developing roller gear and a driven gear according to a third disclosed embodiment.

FIG. 16 is a first exploded perspective view of an image forming unit according to a third disclosed embodiment. FIG. 17 is a second exploded perspective view of the image forming unit according to the third disclosed embodiment. FIG. 18 is a schematic view of relationship among a developing roller gear, a driven gear, and a toner supplying roller gear according to the third disclosed embodiment. FIG. 19 is a schematic view of a rotation transmitting system of the image forming unit according to the third disclosed embodiment. FIG. 20 is a schematic view of relationship between the developing roller gear and the driven gear according to the third disclosed embodiment.

The reference numeral 59 is a developing roller unit, operating as a first unit. The reference numeral 63 is a toner supplying roller unit, operating as a second unit that is provided to be adjacent to the developing roller unit 59.

The developing roller unit 59 has a photoreceptor drum 11, operating as an image carrier, a developing roller 16, operating as a first rotating body and a developer carrier, and side plates 19*a* and 19*b* that hold the above mentioned structures.

The toner supplying roller unit 63 has a toner supplying roller 18, operating as a second rotating body and a developer supplying part, and side plates 47*a* and 47*b* that hold the toner supplying roller 18.

The photoreceptor drum 11 is rotatably supported by the side plates 19*a* and 19*b*. The photoreceptor drum 11 rotates in the K direction when the rotation of a motor (not shown), operating as a drive part, is transmitted to a drum gear 44 located in one end through a motor gear 50 and a reduction gear 51. Similarly, the developing roller 16 is rotatably supported by the side plates 19*a* and 19*b*. The developing roller 16 rotates in the L direction when the rotation of the photoreceptor drum 11 is transmitted to a developing roller gear 37, operating as a first gear, that meshes with the drum gear 44 and is located in one end. The developing roller 16 rotates at a certain rotation speed that has a certain speed difference compared to the rotation speed of the photoreceptor drum 11. The toner supplying roller 18 rotates in the same direction of the developing roller 16 at a certain rotation speed that has a certain speed difference compared to the rotation speed of the developing roller 16.

The toner supplying roller 18 is rotatably supported by the side plates 47*a* and 47*b*. The toner supplying roller 18 rotates in the R direction when the rotation of the developing roller gear 37 is transmitted to a driven gear 62, operating as a second gear, that meshes with a toner supplying roller gear 61 and is located in one end. The driven gear 62 is rotatably supported by the side plates 19*a* and 19*b*. When the toner supplying roller unit 63 is attached to the developing roller unit 59, the driven gear 62 meshes with the toner supplying roller gear 61.

Cylindrical projection parts 64*a*, 64*b*, 65*a*, and 65*b*, operating as first engaging components, are formed at the side plates 47*a* and 47*b*. The groove parts 66*a*, 66*b*, 67*a*, and 67*b*, operating as second engaging components, are formed at the side plates 19*a* and 19*b*. When the toner supplying roller unit 63 is attached to the developing roller unit 59, the projection parts 64*a*, 64*b*, 65*a*, and 65*b* are engaged with the groove parts 66*a*, 66*b*, 67*a*, and 67*b*, respectively. In this disclosed embodiment, each of the groove parts 66*a* and 67*a* and the groove parts 66*b* and 67*b* is formed as one unit, respectively. However, they can be separately formed after they are independent.

When the toner supplying roller unit 63 is attached to the developing roller unit 59, the developing roller gear 37 meshes with the toner supplying roller gear 61 through the driven gear 62 as shown in FIG. 18. The toner supplying roller 18 rotates at a certain rotation speed that has a certain speed difference compared to the rotation speed of the developing roller 16.

When the toner supplying roller unit 63 is attached to the developing roller unit 59, the engaging positions between the projection parts 64*a* and 64*b* and the groove parts 66*a* and 66*b*, respectively, are located in the vicinity of the area where the toner supplying roller gear 61 meshes with the driven gear 62 as shown in FIGS. 18 and 20. Namely, the engaging positions are located within the area Nb where the outer circumference circle 61*b* of the toner supplying roller gear 61 and the outer circumference circle 62*b* of the driven gear 62 overlap each other as the point of contact gg between the pitch circle 61*a* of the toner supplying roller gear 61 and the pitch circle 62*a* of the driven gear 62 is the center, i.e., within the area where the toner supplying roller gear 61 meshes with the driven gear 62.

The projection parts 64*a* and 64*b* are in the cylindrical shape. When the direction of the mesh pressure angle at the point of contact gg between the teeth of the toner supplying roller gear 61 and the driven gear 62 is in the direction of arrow E' (the E' direction), operating as a bias direction, the groove parts 66*a* and 66*b* are U-shaped along the E' direction. When the direction of the tangent line of the pitch circles 61*a* and 62*a* at the point of contact gg is the J' direction, and when the Q' direction, operating as a driving direction, is perpendicular to the E' direction, an angle between the J' and Q' directions is referred to as the mesh pressure angle $\alpha'$. Note that the angle D' between the E' and Q' directions is 90 degrees.

The toner supplying roller unit 63 is biased in the E' direction by the bias spring 43, operating as a biasing part, that is located at the developing roller unit 59. Therefore, the toner supplying roller 18 uniformly contacts and presses the developing roller 16 in the shaft direction of the roller.

The drive force P' is generated in the Q' direction, which deviates from the J' direction by the mesh pressure angle $\alpha'$ with respect to the rotation of the driven gear 62. However, when an angle between the direction E of the biasing force and the direction of the drive force P is very different from 90°, the drive force P' is generated at one end where the developing roller gear 37 and the toner supplying roller gear 61 of the developing roller 16 and the toner supplying roller 18, respectively, are located and is not generated in another end of the roller. Therefore, the drive force P' affects the situation in which the toner supplying roller 18 uniformly contacts and presses the developing roller 16.

Because the projection parts 64*a* and 64*b* are of a cylindrical shape and the groove parts 66*a* and 66*b* are U-shaped, when the projection parts 64*a* and 64*b* and the groove parts 66*a* and 66*b* are engaged, respectively, the groove parts 66*a* and 66*b* regulates the movement of the projection parts 64*a* and 64*b* in the Q' direction. The groove parts 66*a* and 66*b* can receive the drive force P'. Because the projection parts 64*a* and 64*b* can move in the E' direction along the groove parts 66*a* and 66*b*, and the toner supplying roller unit 63 is biased to the developing roller unit 59 in the E' direction by the bias spring 43, the developing roller 16 and the toner supplying roller 18 are easily and uniformly contacted and pressed each other in the shaft directions.

As discussed above, the engagement position between the projection parts 64*a* and 64*b* and the groove parts 66*a* and 66*b* is located in the vicinity of the area where the toner supplying roller gear 61 meshes with the driven gear 62. The engagement position between the projection parts 65*a* and 65*b* and the groove parts 67*a* and 67*b* is located on the opposite side of the perpendicular line that passes through the center of gravity of the developing roller unit 59 with respect to the engagement position between the projection parts 64*a* and 64*b* and the groove parts 66*a* and 66*b*. A main engaging part, operating as a first engaging part, is configured with the projection parts 64*a* and 64*b* and the groove parts 66*a* and 66*b*. A sub-engaging part, operating as a second engaging part, is configured with the projection parts 65*a* and 65*b* and the groove parts 67*a* and 67*b*.

As discussed above, when the direction of the mesh pressure angle in the point of contact gg between the teeth of the toner supplying roller gear 61 and the driven gear 62 is in the direction of arrow E' (the E' direction), the groove parts 66*a* and 66*b* are U-shaped along the E direction. The groove parts 66*a* and 66*b* regulate the movement of the projection parts 64*a* and 64*b* in the Q' direction. As a result, the drive force P' is negated by the groove parts 66*a* and 66*b*.

The groove parts 67*a* and 67*b*, located at the developing roller unit 59, are integrated with the groove parts 66*a* and 66*b* and are elongated in a liner fashion. The projection parts 65*a* and 65*b*, located at the toner supplying roller unit 63, are of a cylindrical shape. Therefore, when the projection parts 65*a* and 65*b* and the groove parts 67*a* and 67*b* are engaged, respectively, the groove parts 67*a* and 67*b* regulate the movement of the projection parts 65*a* and 65*b* in the Q' direction. The groove parts 66*a* and 66*b* can receive the drive force P'. Because the projection parts 65*a* and 65*b* can move in the E' direction along the groove parts 66*a* and 66*b*, and the toner supplying roller unit 63 is biased in the E' direction towards the developing roller unit 59 by the bias spring 43, the developing roller 16 and the toner supplying roller 18 are easily and uniformly contacted and press each other in the shaft directions.

In this disclosed embodiment, the angle D' is set to 90 degrees. However, when misalignment occurs, for example, at the point of contact gg where the toner supplying roller gear 61 and the driven gear 62 are meshed, at the engagement positions between the projection parts 64*a* and 64*b* and the groove parts 66*a* and 66*b*, and/or at the engagement positions between the projection parts 65*a* and 65*b* and the groove parts 67*a* and 67*b*, there is a possibility that some variations for the angle D' may occur.

Experiments in which images were formed (i.e., printed) using several different angles D' were performed to determine whether the image quality was decreased or not at these different angles. The determination results are shown in Table 2 below.

TABLE 2

| Angle D' (°) | 80 | 82.5 | 85 | 87.5 | 90 | 92.5 | 95 | 97.5 | 100 |
|---|---|---|---|---|---|---|---|---|---|
| Jitter | x | Δ | ○ | ○ | ○ | ○ | ○ | Δ | x |
| Spot | ○ | ○ | ○ | ○ | ○ | ○ | ○ | x | x |
| Blur | x | x | ○ | ○ | ○ | ○ | ○ | ○ | ○ |

In these experiments, a certain number of sheets was printed using several different angles D', 80°, 82.5°, 85°, 87.5°, 90°, 92.5°, 95°, 97.5°, and 100°. Each time it was determined whether the image quality decreased or not. An A3 size sheet, which is the largest sheet applicable for a printer of the experiments was used. 25% duty printing in which some dots are uniformly pulled from the solid printing was performed.

If, after the certain number of sheets was printed, jitters, spots, and blurs occurred on none of the sheets, the mark "○" was used; if jitters, spots, and blurs occurred on all of the sheets, the mark "x" was used; and if jitters, spots, and blurs occurred on some, but not all, of the sheets, the mark "Δ" was used.

When the angle D' was larger, a component of the drive force P' that was based on the meshing of the toner supplying roller gear 61 and the driven gear 62 was applied in the direction in which the pressing force between the developing roller 16 and the toner supplying roller 18 was increased, so that jitters and spots occurred. When the angle D' was smaller, the component of the drive force P' that was based on the meshing of the toner supplying roller gear 61 and the driven gear 62 was applied in the direction in which the pressing force between the developing roller 16 and the toner supplying roller 18 was decreased, so that jitters and blurs occurred. As a result, in these experiments, it was understood that when the angle D' is in the following range, $85° \leqq D' \leqq 95°$, jitters, spots and blurs did not occur, and the image quality was not decreased.

In the present disclosed embodiment, as discussed above, the developing roller 16 and the toner supplying roller 18 are easily and uniformly contacted and pressed to each other in the shaft direction because of the following features: (1) the projection parts 64*a* and 64*b*, and the groove parts 66*a* and 66*b* are located in the vicinity of the area in which the toner supplying roller gear 61 and the driven gear 62 are meshed; (2) the grooves 66*a*, 66*b*, 67*a*, and 67*b* receive the drive force P' that is generated through the meshing of the toner supplying roller gear 61 and the driven gear 62; (3) the toner supplying roller unit 63 is movable in the E' direction; and (4) the toner supplying roller unit 63 is biased toward the developing roller unit 59 by the bias spring 43.

Because the position of the toner supplying roller 18 is changed and adjusted while the pressing force between the developing roller 16 and the toner supplying roller 18 is measured, workability for contacting and pressing between the developing roller 16 and the toner supplying roller 18 with the uniform pressing force is improved.

Next, a fourth disclosed embodiment is explained. Structures that have the same structures of the first through third disclosed embodiments are assigned the same reference numerals. The effects of the first through third disclosed embodiments are incorporated herein for an effect based on the same structures.

Figure 21:
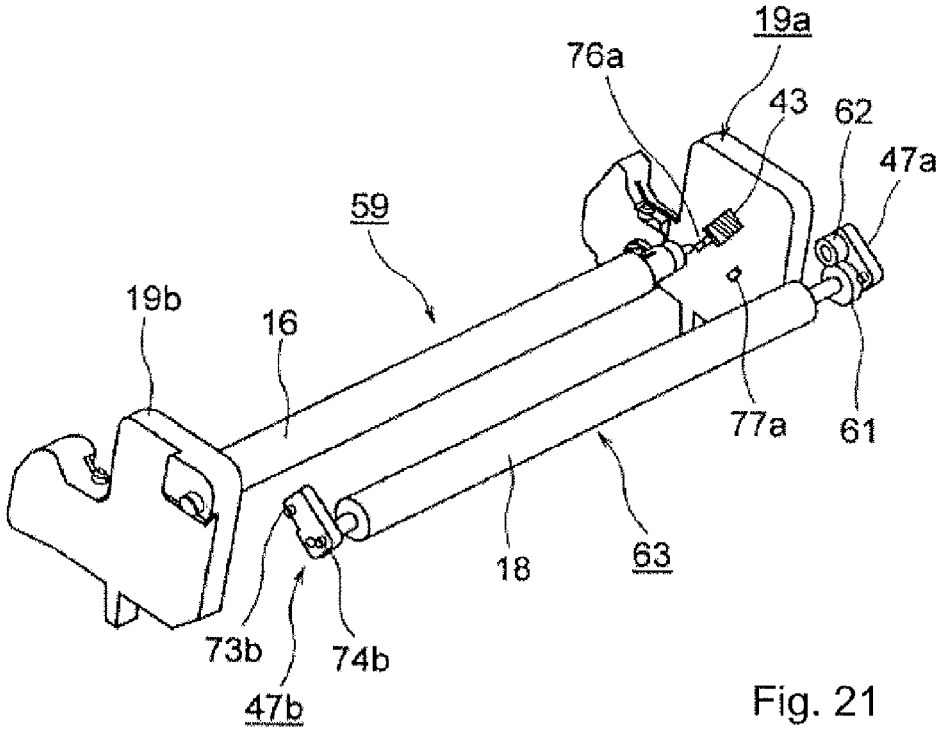
FIG. 21 is a first exploded perspective view of an image forming unit according to a fourth disclosed embodiment.
Figure 22:
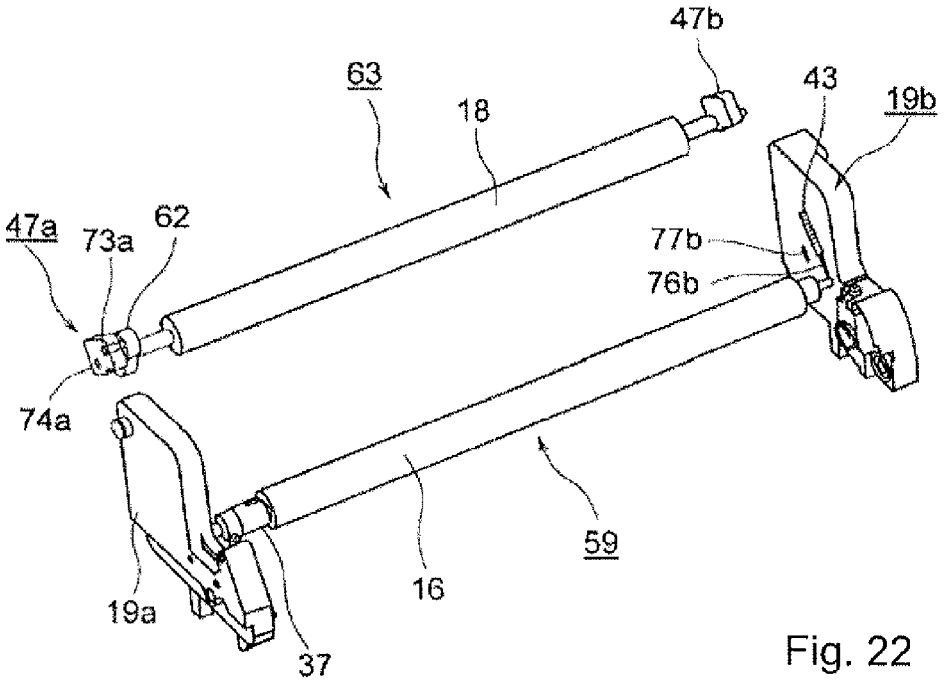
FIG. 22 is a second exploded perspective view of an image forming unit according to a fourth disclosed embodiment.
Figure 23:
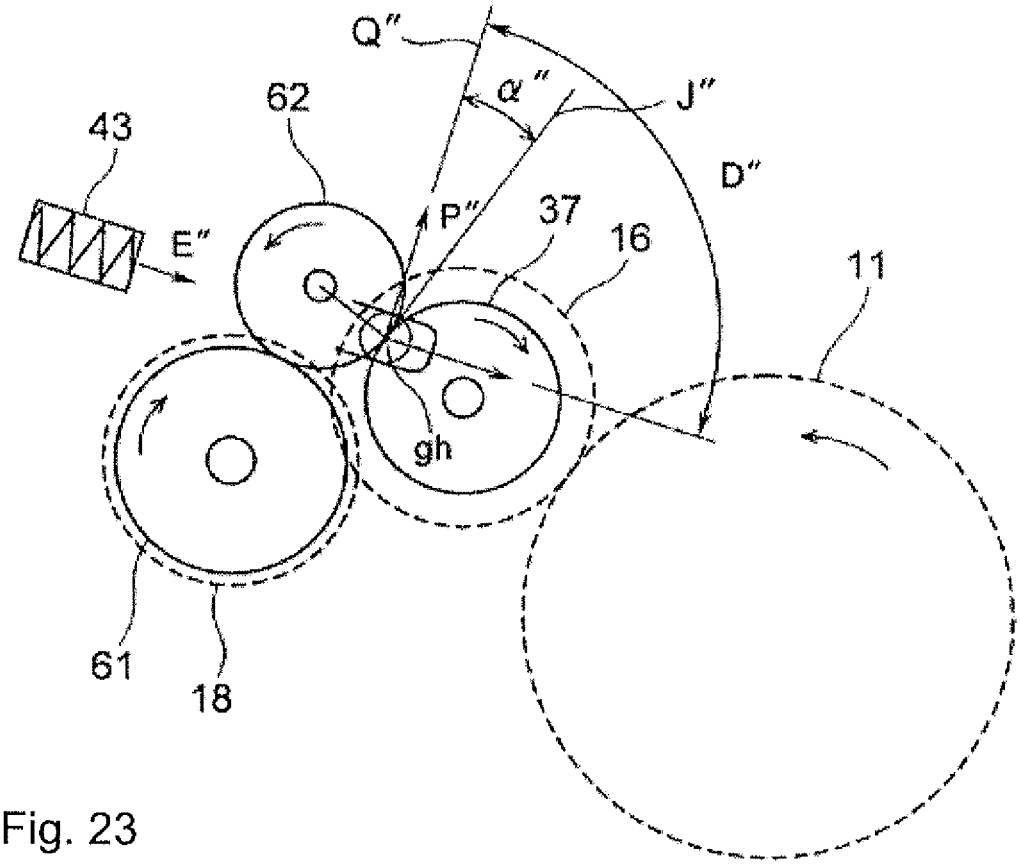
FIG. 23 is a schematic view of relationship among a developing roller gear, a driven gear, and a toner supplying roller gear according to a fourth disclosed embodiment.
Figure 24:
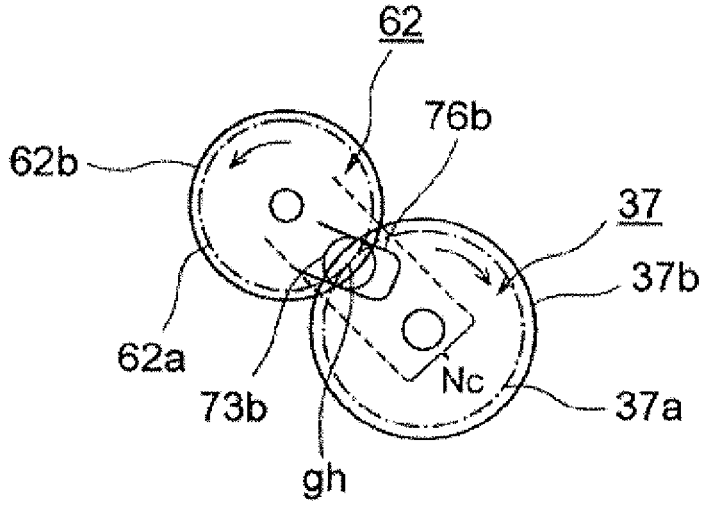
FIG. 24 is a schematic view of relationship between a driven gear and a toner supplying roller gear according to a fourth disclosed embodiment.

FIG. 21 is a first exploded perspective view of an image forming unit according to the fourth disclosed embodiment. FIG. 22 is a second exploded perspective view of the image forming unit according to the fourth disclosed embodiment. FIG. 23 is a schematic view of relationship among a developing roller gear, a driven gear, and a toner supplying roller gear according to the fourth disclosed embodiment. FIG. 24 is a schematic view of relationship between the driven gear and the toner supplying roller gear according to the fourth disclosed embodiment.

Cylindrical projection parts 73*a*, 73*b*, 74*a*, and 74*b*, operating as first engaging components, are formed at side plates 47*a* and 47*b*. Groove parts 76*a*, 76*b*, 77*a*, and 77*b*, operating as second engaging components, are formed at side plates 19*a* and 19*b*. When the toner supplying roller unit 63, operating as a second unit, is attached to the developing roller unit 59, operating as a first unit, the projection parts 73*a*, 73*b*, 74*a*, and 74*b* are engaged with the groove parts 76*a*, 76*b*, 77*a*, and 77*b*, respectively. The toner supplying roller 18 is biased toward the developing roller 16 by a bias spring 43, operating as a biasing part.

When the toner supplying roller unit 63 is attached to the developing roller unit 59, the developing roller gear 61 meshes with the developing roller gear 37 through the driven gear 62, as shown in FIG. 23. In this embodiment, the developing roller gear 61 is located at the developing roller unit 59; the developing roller gear 37 operates as a first gear and is located at the toner supplying roller unit 63; and the driven gear 62 operates as a second gear and is located at the toner supplying roller unit 63. The toner supplying roller 18, operating as a second rotating body and as a developer supplying part, rotates at a certain rotation speed that has a certain speed difference compared to the rotation speed of the developing roller 16, operating as a first rotating body and as a developer carrier.

When the toner supplying roller unit 63 is attached to the developing roller unit 59, the engaging positions between the projection parts 73*a* and 73*b* and the groove parts 76*a* and 76*b*, respectively, are located in the vicinity of the area where the driven gear 62 meshes the developing roller gear 37 as shown in FIGS. 23 and 24. Namely, the engaging positions are located within the area Nc where the outer circumference circle 62*b* of the driven gear 62 and the outer circumference circle 37*b* of the developing roller gear 37 overlap each other as the point of contact gh between the pitch circle 62*a* of the driven gear 62 and the pitch circle 37*a* of the developing roller gear 37 is the center, i.e., within the area where the driven gear 62 meshes with the developing roller gear 37.

The projection parts 73*a* and 73*b* are in a cylindrical shape. When the direction of the mesh pressure angle in the point of contact gh between the teeth of the driven gear 62 and the developing roller gear 37 is in the direction of arrow E" (the E" direction), operating as a biasing direction, the groove parts 76*a* and 76*b* are U-shaped along the E" direction. When the direction of the line tangent to the pitch circles 62*a* and 37*a* at the point of contact gh is the J" direction, and when the direction perpendicular to the E" direction is the Q" direction, operating as a driving direction, an angle between the J" and Q" directions is referred to as the mesh pressure angle $\alpha$". Note that the angle D" between the E" and Q" directions is 90 degrees.

The toner supplying roller unit 63 is biased in the E" direction by the bias spring 43 that is located at the developing roller unit 59. Therefore, the toner supplying roller 18 uniformly contacts and presses the developing roller 16 in the shaft direction of the roller.

The drive force P" is generated in the Q" direction, which deviates from the J" direction by the mesh pressure angle $\alpha$" with respect to the rotation of the driven gear 62. However, when an angle between the direction E of the biasing force and the direction of the drive force P is very different from 90°, the drive force P" is generated in one end where the developing roller gear 37 and the toner supplying roller gear 61 of the developing roller 16 and the toner supplying roller 18, respectively, are located and is not generated in another end of the roller. Therefore, the drive force P" affects the situation in which the toner supplying roller 18 uniformly contacts and presses the developing roller 16.

Because the projection parts 73*a* and 73*b* are of a cylindrical shape and the groove parts 76*a* and 76*b* are U-shaped, when the projection parts 73*a* and 73*b* and the groove parts 76*a* and 76*b* are engaged, respectively, the groove parts 76*a* and 76*b* regulate the movement of the projection parts 73*a* and 73*b* in the Q" direction. The groove parts 76*a* and 76*b* can receive the drive force P". Because the projection parts 73*a* and 73*b* can move in the E" direction along the groove parts 76*a* and 76*b*, and the toner supplying roller unit 63 is biased to the developing roller unit 59 in the E" direction by the bias spring 43, the developing roller 16 and the toner supplying roller 18 are easily and uniformly contacted and pressed against each other in the shaft directions.

As discussed in the third disclosed embodiment, the engagement position between the projection parts 74*a* and 74*b* and the groove parts 77*a* and 77*b* is located on an opposite side to the perpendicular line that passes through the center of gravity of the developing roller unit 59 with respect to the engagement position between the projection parts 73*a* and 73*b* and the groove parts 76*a* and 76*b*. The groove parts 77*a* and 77*b* regulate the movement of the projection parts 74*a* and 74*b* in the Q" direction. As a result, the drive force P" is negated by the groove parts 77*a* and 77*b*. A main engaging part, operating as a first engaging part, is configured with the projection parts 73*a* and 73*b* and the groove parts 76*a* and 76*b*. A sub-engaging part, operating as a second engaging part, is configured with the projection parts 74*a* and 74*b* and the groove parts 77*a* and 77*b*.

In this disclosed embodiment, the angle D" is also set to 90 degrees. However, when misalignment occurs, for example, at the point of contact gh where the driven gear 62 and the developing roller gear 37 are meshed, at the engagement positions between the projection parts 73*a* and 73*b* and the groove parts 76*a* and 76*b*, and/or at the engagement positions between the projection parts 74*a* and 74*b* and the groove parts 77*a* and 77*b*, there is a possibility that some variations for the angle D" may occur.

In these experiments, it was understood that when the angle D" is in the following range, $85° \leqq D" \leqq 95°$, jitters, spots and blurs did not occur, and the image quality was not decreased.

In the present disclosed embodiment, as discussed above, the developing roller 16 and the toner supplying roller 18 are easily and uniformly contacted and pressed each other in the shaft directions because of the following features: (1) the projection parts 73*a* and 73*b*, and the groove parts 76*a* and 76*b* are located in the vicinity of the area in which the driven gear 62 and the developing roller gear 37 are meshed; (2) the grooves 76*a*, 76*b*, 77*a*, and 77*b* receive the drive force P" that is generated through the meshing of the driven gear 62 and the developing roller gear 37; (3) the toner supplying roller unit 63 is provided to be movable in the E" direction; and (4) the toner supplying roller unit 63 is biased toward the developing roller unit 59 by the bias spring 43.

Because the position of the toner supplying roller 18 is changed and adjusted while the pressing force between the developing roller 16 and the toner supplying roller 18 is measured, workability for contacting and pressing between the developing roller 16 and the toner supplying roller 18 with the uniform pressing force is improved.

In the embodiments discussed above, the printer as the image forming device is explained. However, the d disclosed system is not limited to the structure discussed above and may be applicable to a copier, a facsimile machine, a multifunction peripheral (MFP), and so on.

The instant disclosure is provided to further explain in an enabling fashion the best modes of performing one or more embodiments. The image forming device being thus described, it will be apparent that the same may be varied in many ways. Such variations are not to be regarded as a departure from the sprit and scope of the invention, and all such modifications as would be apparent to one of ordinary skill in the art are intended to be included within the scope of the following claims. The invention is defined solely by the appended claims including any amendments made during the pendency of this application and all equivalents of those claims as issued.

What is claimed is:

1. An image forming unit comprising:

a first rotating body having a first gear;

a first unit that rotatably supports the first rotating body;

a second rotating body having a second gear;

a second unit that rotatably supports the second rotating body; and a biasing part that generates a bias force and that biases the second unit toward the first unit at a point of contact at which the first gear and the second gear contact each other, wherein a drive force is generated by transmitting rotation from the first gear to the second gear in order to transmit the rotation from the first rotating body to the second rotating body, the biasing part biases the second unit in a biasing direction substantially perpendicular to a driving direction of the drive force, the biasing part is positioned at a downstream side of the point of contact in the driving direction of the drive force, a mesh pressure angle is an angle of pressure based on meshing of the first and second gears, and the biasing direction and the mesh pressure angle are substantially parallel with each other.

2. The image forming unit according to claim 1, wherein the driving direction is shifted from a line that is tangent to a first pitch circle of the first gear and a second pitch circle of the second gear by a mesh pressure angle that is an angle of pressure based on the meshing of the first and second gears.

3. The image forming unit according to claim 1, wherein a first engaging component is formed in one of the first and second units and is a projection part, and a second engaging component that is engaged with the first engaging component is formed in the other of the first and second units and is a groove part.

4. The image forming unit according to claim 3, wherein an engagement position between the first and second engaging components is located in an area where an outer circumference circle of the first gear meshes with an outer circumference circle of the second gear.

5. The image forming unit according to claim 4, further comprising:

a third engaging component that is formed in the first unit, and that is different from the first engaging component; and a fourth engaging component that is engaged with the third engaging component and that is formed in the second unit; wherein a main engaging part is formed with the first and second engaging components, a sub-engaging part is formed with the third and fourth engaging components, and an engaging position of the main engaging part is located on an opposite side from an engaging position of the sub-engaging part with respect to a line that passes through the center of gravity of the first unit.

6. The image forming unit according to claim 5, wherein the second engaging component regulates the movement of the first engaging component in the driving direction of the drive force and allows the movement of the first engaging component in the biasing direction, and the fourth engaging component regulates the movement of the third engaging component in the driving direction of the drive force and allows the movement of the third engaging component in the biasing direction.

7. The image forming unit according to claim 3, wherein the groove part is formed in a mesh pressure angle, wherein the mesh pressure angle is an angle of pressure based on the meshing of the first and second gears.

8. The image forming unit according to claim 1, wherein an angle D between the biasing direction and the driving direction is in a range between 85° and 95°.

9. The image forming unit according to claim 1, wherein the biasing part is formed in the second unit.

10. The image forming unit according to claim 1, wherein the biasing part is formed in an upper cover of a main body.

11. The image forming unit according to claim 1, wherein the first unit is a drum unit, the first rotating body is a photoreceptor drum, the second unit is a developing unit, and the second rotating body is a developing roller that contacts and presses the photoreceptor drum.

12. The image forming unit according to claim 11, wherein the first gear is formed in the photoreceptor drum, and the second gear is formed in the developing roller.

13. The image forming unit according to claim 1, wherein the first unit is a developing roller unit, wherein the first rotating unit is a developing roller, wherein the second unit is a toner supplying roller unit, wherein the second rotating unit is a toner supplying roller, and wherein the toner supplying roller contacts and presses the developing roller.

14. The image forming unit according to claim 13, wherein the first gear is formed in the developing roller, and the second gear is a driven gear that connects the first gear with a toner supplying roller gear formed in the toner supplying roller.

15. The image forming unit according to claim 13, wherein the first gear is a driven gear that connects a developing roller gear with a toner supplying roller gear, and the second gear is the toner supplying roller gear.

16. An image forming device comprising an image forming unit according to claim 1.

17. The image forming unit according to claim 1, wherein the biasing part and the point of contact are positioned across the center of gravity of the first unit, and the drive force and the bias force are in different directions.

18. An image forming unit comprising:

a first rotating body having a first gear;

a first unit that rotatably supports the first rotating body;

a second rotating body having a second gear;

a second unit that rotatably supports the second rotating body; and a biasing part that generates a bias force and that biases the second unit toward the first unit at a point of contact at which the first gear and the second gear contact each other, wherein a drive force is generated by transmitting rotation from the first gear to the second gear in order to transmit the rotation from the first rotating body to the second rotating body, the biasing part biases the second unit in a biasing direction substantially perpendicular to a driving direction of the drive force, the biasing part is positioned at a downstream side of the point of contact in the driving direction of the drive force, and an angle D between the biasing direction and the driving direction is in a range between 85° and 95°.

19. An image forming unit comprising:

a first rotating body having a first gear;

a first unit that rotatably supports the first rotating body;

a second rotating body having a second gear;

a second unit that rotatably supports the second rotating body; and a biasing part that generates a bias force and that biases the second unit toward the first unit at a point of contact at which the first gear and the second gear contact each other, wherein a drive force is generated by transmitting rotation from the first gear to the second gear in order to transmit the rotation from the first rotating body to the second rotating body, the biasing part biases the second unit in a biasing direction substantially perpendicular to a driving direction of the drive force, the biasing part is positioned at a downstream side of the point of contact in the driving direction of the drive force, and the biasing part is formed in the second unit.

* * * * *